US006666191B2

(12) United States Patent
Nakagawa et al.

(10) Patent No.: US 6,666,191 B2
(45) Date of Patent: Dec. 23, 2003

(54) CONTROL APPARATUS FOR INTERNAL COMBUSTION ENGINE

(75) Inventors: Shinji Nakagawa, Hitachinaka (JP); Minoru Ohsuga, Hitachinaka (JP); Toshio Hori, Hitachinaka (JP); Hidefumi Iwaki, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 42 days.

(21) Appl. No.: 09/941,946

(22) Filed: Aug. 30, 2001

(65) Prior Publication Data

US 2002/0189590 A1 Dec. 19, 2002

(30) Foreign Application Priority Data

Jun. 19, 2001 (JP) ..... 2001-185189

(51) Int. Cl.[7] ..... F02D 41/10

(52) U.S. Cl. ..... 123/480; 123/492; 123/677; 123/678; 701/104

(58) Field of Search ..... 701/104; 123/677, 123/678, 480, 492

(56) References Cited

U.S. PATENT DOCUMENTS 4,168,679 A 9/1979 Ikeura et al.
4,424,785 A 1/1984 Ishida et al.
4,430,975 A * 2/1984 Ishida et al. ..... 123/478
4,462,358 A * 7/1984 Ishida et al. ..... 123/337
4,524,745 A * 6/1985 Tominari et al. ..... 123/478
4,796,591 A * 1/1989 Kiyono et al. ..... 123/492

FOREIGN PATENT DOCUMENTS

| | | |
|---|---|---|
| DE | 4215107 | 1/1994 |
| EP | 0987417 | 3/2000 |
| JP | 11159377 | 6/1999 |
| JP | 2000097086 | 4/2000 |

* cited by examiner

*Primary Examiner*—Erick Solis
(74) *Attorney, Agent, or Firm*—Crowell & Moring LLP

(57) ABSTRACT

Provided is a control apparatus for a fuel priority type internal combustion engine, including a means of directly or indirectly detecting a variation in air density, for correcting a maximum value of the desired fuel volume on a basis of a result of the detection so as to adjust the relationship between an accelerator opening degree and the desired fuel volume, or a shaft torque value and a desired fuel volume are determined in accordance with a fuel volume corresponding to an internal loss and a fuel volume corresponding to a maximum value of the desired fuel volume.

18 Claims, 30 Drawing Sheets

<FUEL INJECTION VOLUME COMPUTING PART>

<FUEL INJECTION VOLUME COMPUTING PART>

CONTROL APPARATUS FOR INTERNAL COMBUSTION ENGINE

FIELD OF THE INVENTION

The present invention relates to a control apparatus for an internal combustion engine, and in particular to a control apparatus for an internal combustion engine, which can precisely control the volume of fuel or air in a fuel-priority type internal combustion engine wherein the flow rate of air is controlled by an electronic control valve.

BACKGROUND OF THE INVENTION

These years, even in the technical field of automobiles, there has been demanded internal combustion engines of low fuel consumption type on the background of worldwide efforts for energy saving measures. As to internal combustion engines which can satisfy the above-mentioned demand, lean-burn type internal combustion engines have been most preferable. Among the lean-burn type internal combustion engines, a cylinder injection type internal combustion engine can, in particular, perform combustion with an air-fuel ratio higher than 40 by directly injecting fuel into an engine cylinder so as to stratify the mixture, thereby it is possible to aim at reducing pumping loss.

In comparison with control systems for conventional internal combustion engine, a control system for the above-mentioned lean-burn cylinder injection type internal combustion engine utilizes, in general, an electronic throttle for electronically controlling an air flow rate since no proportional relationship is present between the air flow rate and the torque of the engine.

Further, the control system for a lean-burn internal combustion engine requires torque demand control in order to obtain a toque the driver desires over a broad air-fuel ratio range. There has been two types of the torque demand, that is, an air priority type and a fuel priority type.

As to the air priority type, as shown in FIG. 14, a desired torque computing means and a desired air-fuel ratio computing means determine a desired torque and a desired air-fuel ratio, and a desired air-fuel volume computing means computes a desired air volume with which the desired torque and the desired air-fuel ratio can be obtained. Then, an electronic throttle controls the air-volume while an air volume sensor detects an actual air volume, and a fuel injection volume computing means determines a fuel injection volume from the actual air volume and the desired air-fuel ratio.

On the contrary, as to the fuel priority type, as shown in FIG. 15, a desired torque computing means determines a desired torque, and a fuel injection volume computing means determines a fuel injection volume with which the desired torque is obtained. Further, a desired air-volume computing means computes a desired air volume from the desired fuel injection volume and a desired air-fuel ratio, and then an electronic throttle controls the air volume. Further, with the fuel priority type, F/B control can be made for the air volume in accordance with an output value from an air-flow rate sensor.

By the way, as mentioned above, in the fuel priority type, a technique for computing a desired fuel volume with which a desired torque can be obtained, from an accelerator opening degree and a speed of the internal combustion engine, is in general used. Accordingly, it is required to previously determine the relationship between the accelerator opening degree and the desired fuel volume, depending upon a performance of the internal combustion engine.

Meanwhile, it is required to maintain the air-fuel ratio at a constant value in order to efficiently purify exhaust gas from an internal combustion, and accordingly it is required to set the maximum value of the fuel volume to a value corresponding to an air volume in an engine cylinder upon full opening of a throttle. Should a fuel volume greater than the value corresponding to an air volume in an engine cylinder upon full opening of the throttle be fed into the internal combustion engine, fuel would be excessive, resulting in deterioration of HC and CO.

However, the air-volume in the engine cylinder upon full opening of the throttle varies, depending upon the atmospheric pressure and the atmospheric temperature or EGR, opening and closing timing of intake and exhaust valves and the like. For example, when the atmospheric pressure lowers and the air volume in an engine cylinder decreases upon full opening of the throttle, fuel becomes excessive if a predetermined fuel volume as mentioned above is fed into the internal combustion engine upon full opening of accelerator, resulting in deterioration of exhaust gas.

On the contrary, if, for example, the opening and closing timing of the intake and exhaust valves varies so that the air volume in the engine cylinder upon full opening of the throttle increases, the throttle does not reach its full opening even though the accelerator is fully opened, and accordingly, a maximum torque cannot be obtained, thereby it is possible to raise such a problem that the performance of the internal combustion engine cannot be sufficiently used.

Further, the fuel volume fed into the internal combustion engine is in general divided mainly into a part for an internal loss and a part for a shaft torque. However, the internal loss is not uniform, but varies due to such causes as unevenness in mass production and aging effect. As mentioned above, the fuel volume to be fed is limited to the value corresponding to an air volume in an engine cylinder upon full opening of the throttle, and accordingly, there has been raised such a problem that since the internal loss varies, the shaft torque should be adjusted accordingly.

In view of the facts as mentioned above, the control for the fuel priority type internal combustion engine requires changing the maximum value of the fuel supply volume in accordance with an air volume in the engine cylinder upon full opening of the throttle, and further, requires changing the fuel volume for the shaft torque in view of a maximum value of the fuel supply volume and an internal loss. With the provision of these functions, it can be expected to enhance the exhaust performance and the operating performance.

As prior art of control for the fuel priority fuel injection type internal combustion engine, there has been proposed (Japanese Laid-Open H11-159317) a control device for controlling the throttle opening degree in order to compensate a delay of air from the throttle to the cylinder. Further, as to prior art of another control for the fuel priority cylinder injection type internal combustion engine, there has been proposed (Japanese Laid-Open Patent No. H11-159377) a control device for adjusting the fuel volume to a phase of an air volume in the cylinder is proposed.

However, any of those of the above-mentioned prior art concerns a control device for compensating a difference between the transmission characteristic of air from the throttle to the engine cylinder and the transmission characteristic of fuel, but does not concerns with a variation in air-volume in the engine cylinder and variation in internal loss upon full-opening of the throttle, that is, no consideration has been made for these variations.

SUMMARY OF THE INVENTION

The present invention is devised in view of the above-mentioned problems, and an object of the present invention is to provide a control apparatus for a fuel priority type internal combustion engine, which is highly robust against variation in various conditions so as to cope with variation in air volume in an engine cylinder, variation in internal loss and the like upon full opening of a throttle throughout the control of the fuel priority cylinder injection internal combustion.

To the end, according to the present invention, there is provided a control apparatus for a fuel priority type internal combustion, which basically computes a desired fuel volume, and then computes a desired air volume from this desired fuel volume and a desired air-fuel ratio, characterized by means for detecting an operating condition of the internal combustion engine, means for detecting an environmental condition surrounding the internal combustion engine, and a means for computing a desired fuel for the internal combustion engine in accordance with the operating condition of the internal combustion engine and the environmental condition surrounding the internal combustion engine (FIG. 1).

Further, in a configuration of the present invention, there is provided a control apparatus for an internal combustion engine which is of a fuel priority type, comprising means for detecting an operating condition of the internal combustion engine, means for detecting an environmental condition surrounding the internal combustion engine, a means for computing a desired fuel volume to be fed into the internal combustion engine, in accordance with the operating condition of the internal combustion engine and the environmental condition surrounding the internal combustion engine, and a means for computing a correction value of the desired fuel volume in accordance with the operating condition of the internal combustion engine and a condition surrounding the internal combustion engine (FIG. 2).

The control device for the internal combustion engine according to the present invention has such a function for computing a desired fuel volume by computing a correction value for the desired fuel volume in accordance with an operating condition of the internal combustion engine, including an accelerator opening degree, and a condition surrounding the internal combustion engine, including a variation in the atmospheric pressure, for changing a maximum value of a fuel supply volume in accordance with an air volume in an engine cylinder upon full opening of a throttle in the fuel priority type internal combustion engine, and for changing a fuel volume for a shaft torque in view of the maximum value of the fuel supply volume and an internal loss, thereby it is possible to obtain an exhaust performance and an operating performance which are robust against various conditions.

Further, in a specific configuration of the control apparatus for an internal combustion engine, the desired fuel volume computing means is adapted to compute a desired fuel injection volume at least from an accelerator opening degree and a speed of the internal combustion engine (FIG. 3).

Further, the means for detecting an environmental condition surrounding the internal combustion engine, is adapted to detect an atmospheric pressure or an atmospheric temperature (FIG. 4). With this arrangement, when the atmospheric pressure and the temperature vary, the maximum inflow air volume varies so that the fuel volume can be corrected accordingly. This correction system may be of a limiter type and a gain type.

Further, the means for detecting an operating condition of the internal combustion engine, includes a means for detecting an opening degree of an EGR valve, a means for detecting opening and closing timing of variable intake and exhaust valves, and a means for directly or indirectly detecting a charging efficiency of air volume in a cylinder of the internal combustion engine, such as a means for detecting an operating angle of a means for enhancing an air flow of intake air (swirl control valve SCV) (FIG. 5). With this arrangement, a charge efficiency in the cylinder is detected, and if the maximum charging efficiency is changed, the fuel volume is corrected accordingly. For example, when the EGR valve is operated, the maximum charging efficiency varies by a value corresponding to an EGR volume, and accordingly, the fuel injection volume is also corrected accordingly. This correction system is of a limiter type or a gain type.

Further, the means for detecting an operating condition of the internal combustion engine includes a means for directly or indirectly detecting a torque or a fuel volume with which the internal combustion engine can maintain a desired speed in its idle condition (FIG. 6). Since there is presented a shaft torque of the internal combustion engine which is given by subtracting an internal loss from an exhibited torque, if the toque for maintaining the idle speed varies, the maximum value of the shaft toque varies accordingly. Thus, the torque for maintaining the idle speed is detected so as to correct the fuel injection volume. This correction system is of a limiter type or a gain type.

Further, the means for detecting an operating condition of the internal combustion engine is a means for detecting an exhaust component from the internal combustion engine (FIG. 7). With this arrangement, Maximum Fuel Volume>Maximum Air Volume (@Atmospheric pressure is low), that is, a rich exhaust air-fuel ratio condition or, Maximum Fuel Volume<Maximum Air Volume (@Atmospheric pressure is high), that is, a lean exhaust air-fuel ratio condition, is computed from an output delivered from an exhaust gas sensor such as an oxygen sensor or an A/F sensor in order to correct the fuel injection volume.

Further, the means for detecting an operating condition of the internal combustion engine includes at least an accelerator opening degree detecting means for detecting an opening degree of the accelerator, a throttle opening degree detecting means for detecting an opening degree of the throttle, and an air volume detecting means for directly or indirectly detecting an air volume flowing into the internal combustion engine (FIG. 8). With this arrangement, a condition, that is, Maximum Fuel Volume>Maximum Air Volume (@Atmospheric pressure is low) or Maximum Fuel Volume<Maximum Air Volume (@Atmospheric pressure is high) is computed from an output delivered from, for example, the accelerator opening degree detecting sensor, a throttle opening degree detecting sensor or an air flow sensor in order to correct the fuel injection volume.

Further, the control apparatus for a fuel priority type internal combustion engine according to the present invention incorporates a desired air-fuel ratio computing device for computing a desired air-fuel ratio, and a desired air volume computing means for computing a desired air volume from the desired fuel volume and the desired air-fuel ratio, the desired fuel volume correction value computing means computing the desired fuel volume correction value when the absolute value of a difference between an actual air volume and the desired air volume is less than a predetermined value while the accelerator opening degree is greater than a predetermined value, and the throttle opening degree is less than a predetermined value (FIG. 9). With this arrangement, if the throttle opening degree does not yet reach its full opening degree even though the accelerator opening degree reaches its full opening degree, such a condition as Maximum Fuel Volume<Maximum Air Volume is obtained, and accordingly, control can be made such that the maximum fuel volume can be increased up to the maximum air volume, thereby it is possible to enhance the exhibition of the maximum torque.

Further, the above-mentioned control apparatus for a fuel priority type internal combustion engine incorporates a desired air-fuel ratio computing device for computing a desired air-fuel ratio, and a desired air volume computing means for computing a desired air volume from the desired fuel volume and the desired air-fuel ratio, the desired fuel volume correction value computing means computing a desired fuel volume correction value when the desire air volume is greater than an actual air volume by a predetermined value while the accelerator opening degree is greater than a predetermined value, and the throttle opening degree is greater than a predetermined value (FIG. 10). With this arrangement, if the throttle opening degree reaches its full opening degree even though the accelerator opening degree does not yet reach its full opening degree, such a condition as Maximum Fuel Volume>Maximum Air Volume is obtained, and accordingly, control can be made such that the maximum volume is decreased up to the maximum air volume, thereby it is possible to prevent deterioration of exhaust gas caused by excessive fuel.

Further, the above-mentioned desired fuel volume correction means may be a means for computing a maximum value or a gain of the desired fuel volume in the relationship among the accelerator opening degree, the desired torque and the desired fuel volume (FIG. 11 and FIG. 12).

Further, the control apparatus for a fuel priority type internal combustion engine according to the present invention comprises means for detecting an operating condition of the internal combustion engine, means for detecting a condition surrounding the internal combustion engine, a charging efficiency control means for controlling the charging efficiency of an air volume in an engine cylinder, such as a supercharger, wherein the charging efficiency control means is controlled in accordance with an operating condition of the internal combustion engine and an environment surrounding the internal combustion engine (FIG. 13). With this arrangement, for example, if the atmospheric pressure becomes lower so that the maximum air volume becomes smaller, the maximum air volume can be increased by the supercharger or the like.

As mentioned above, the control apparatus according to the present invention has such a function that the maximum value of fuel supply volume is changed in accordance with an air volume in a cylinder of the fuel priority type internal combustion upon full opening of the throttle, and the fuel for the shaft torque is changed in consideration with a maximum value of the fuel supply volume and an internal loss, thereby it is possible to offer an exhaust performance and an operating condition which are robust against various conditions.

DETAILED DESCRIPTION OF THE INVENTION

Figure 1:
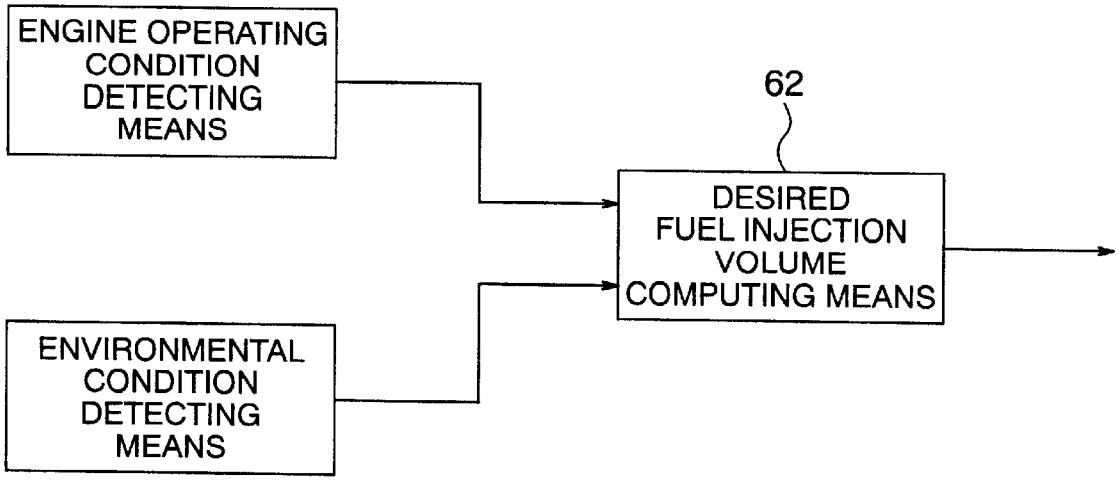
FIG. 1 is a view illustrating a control apparatus for an internal combustion engine in a first aspect of the present invention.
Figure 2:
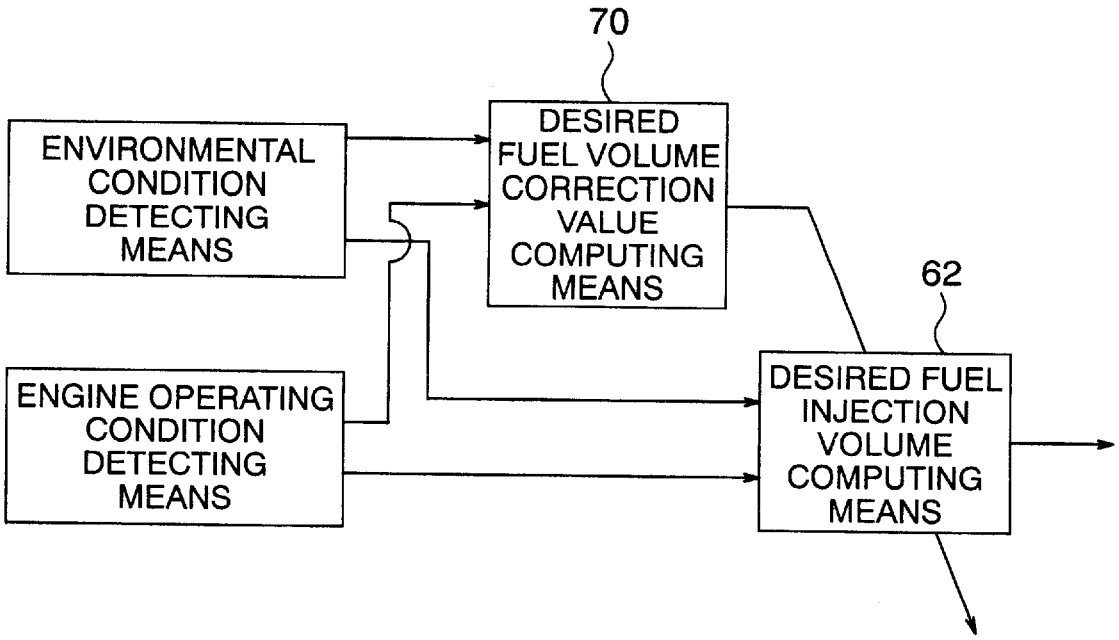
FIG. 2 is a view illustrating a control apparatus for an internal combustion engine in a second aspect of the present invention.
Figure 3:
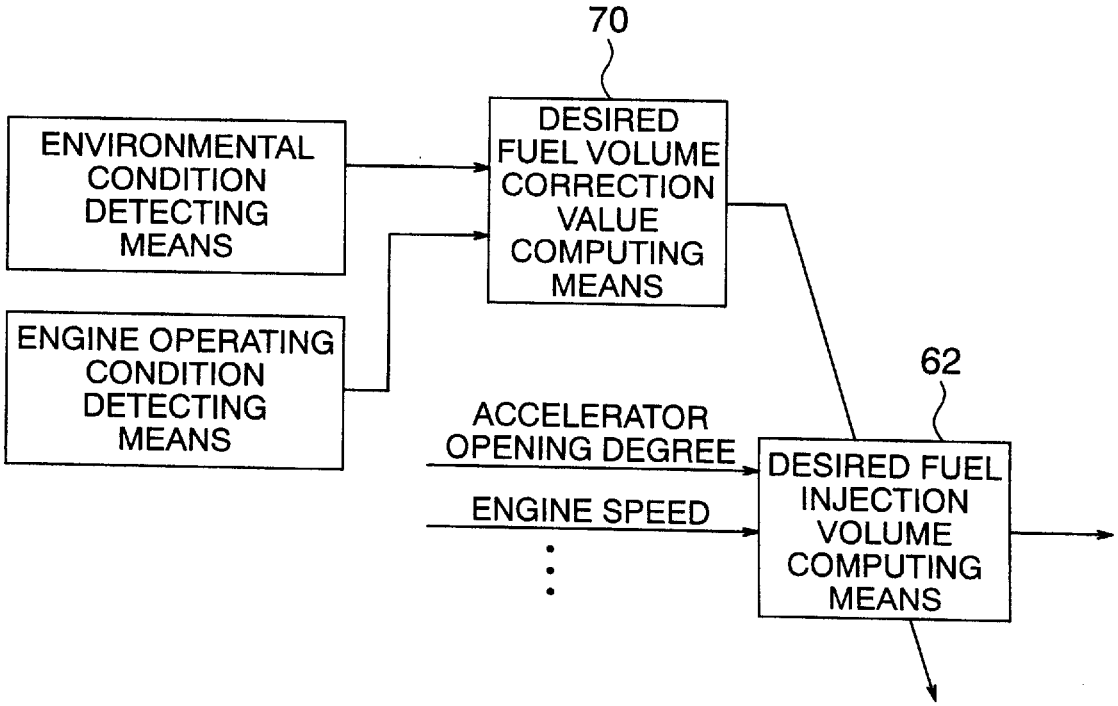
FIG. 3 is a view illustrating a control apparatus for an internal combustion engine in a third aspect of the present invention.
Figure 4:
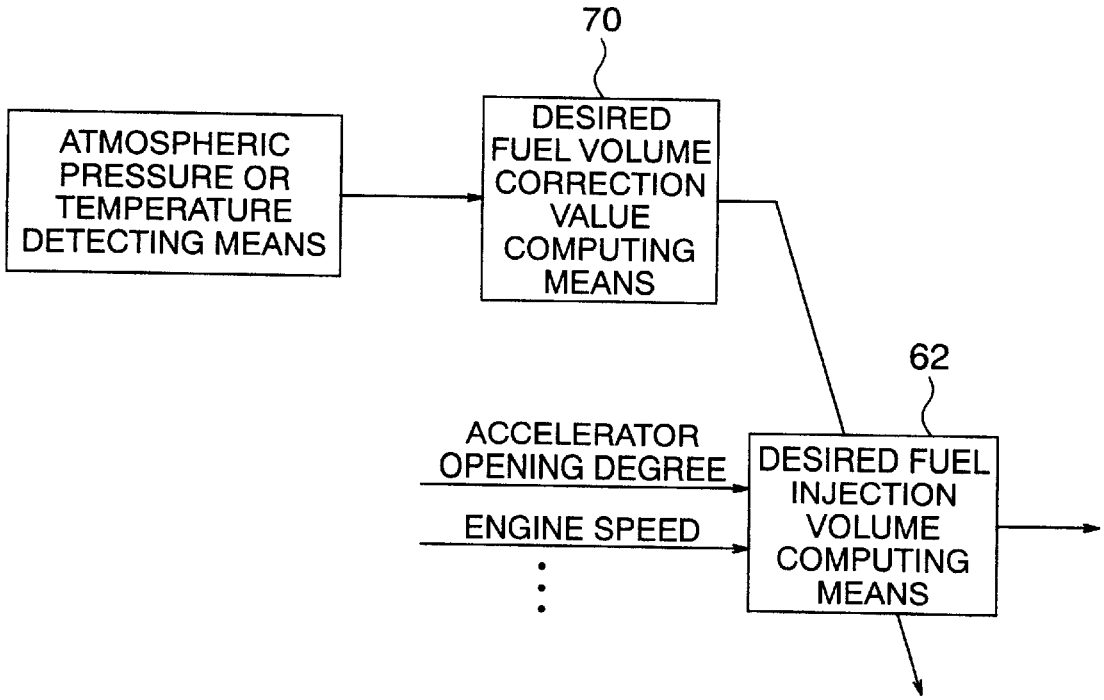
FIG. 4 is a view illustrating a control apparatus for an internal combustion engine in a fourth aspect of the present invention.
Figure 5:
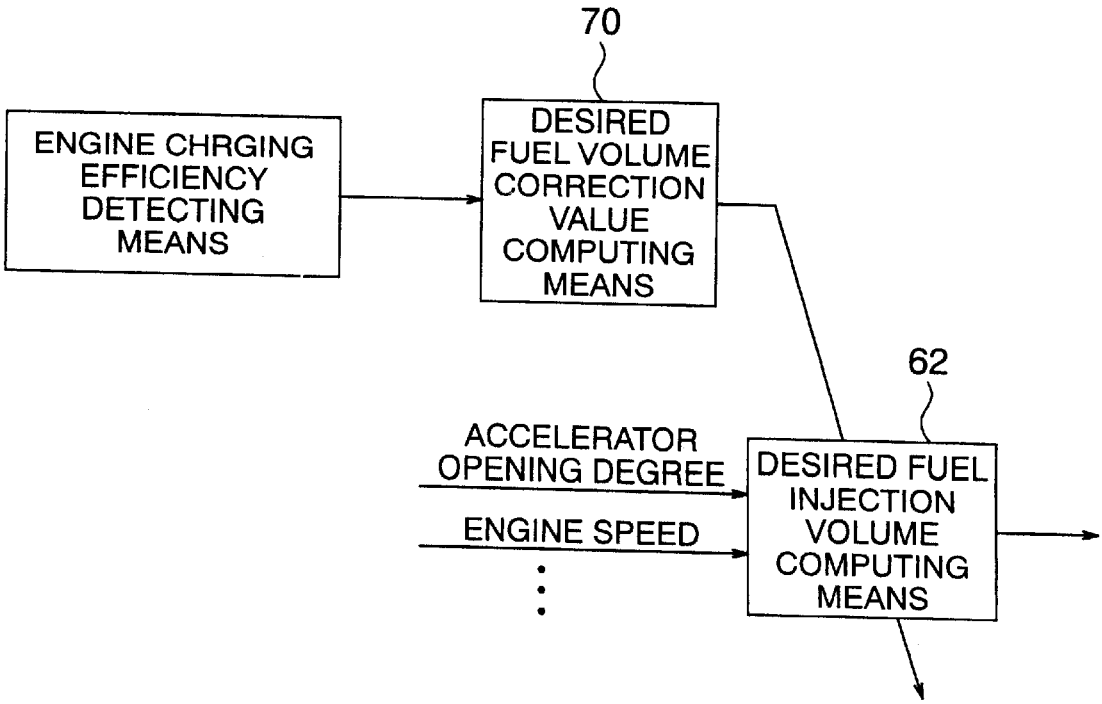
FIG. 5 is a view illustrating a control apparatus for an internal combustion engine in a fifth aspect of the present invention.
Figure 6:
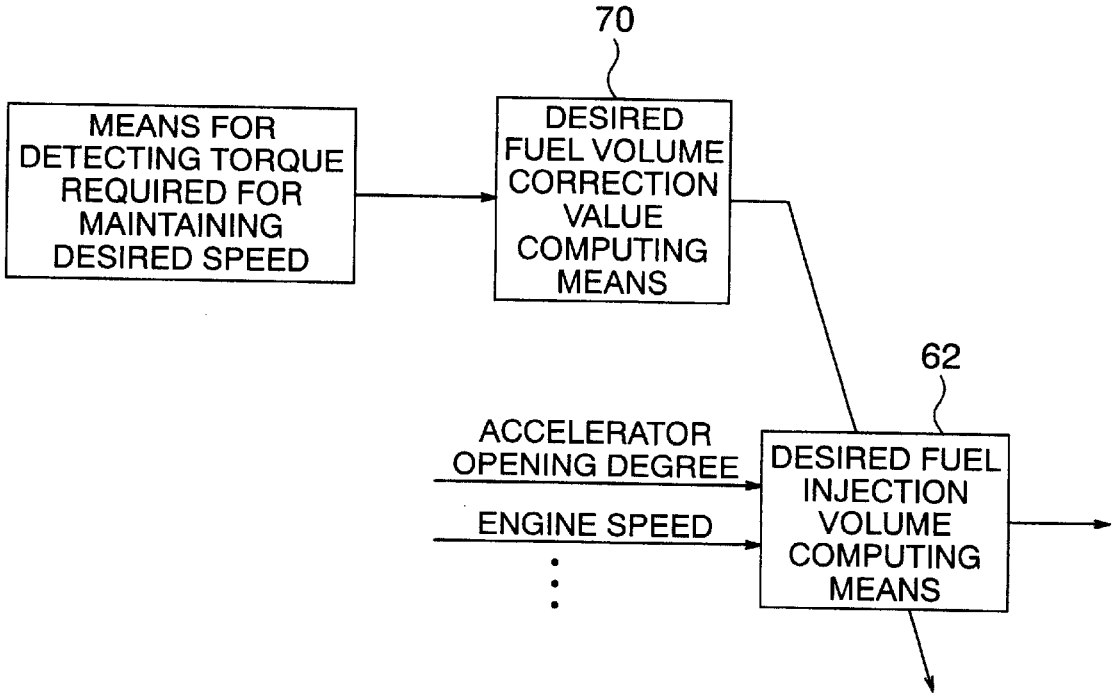
FIG. 6 is a view illustrating a control apparatus for an internal combustion engine in a sixth aspect of the present invention.
Figure 7:
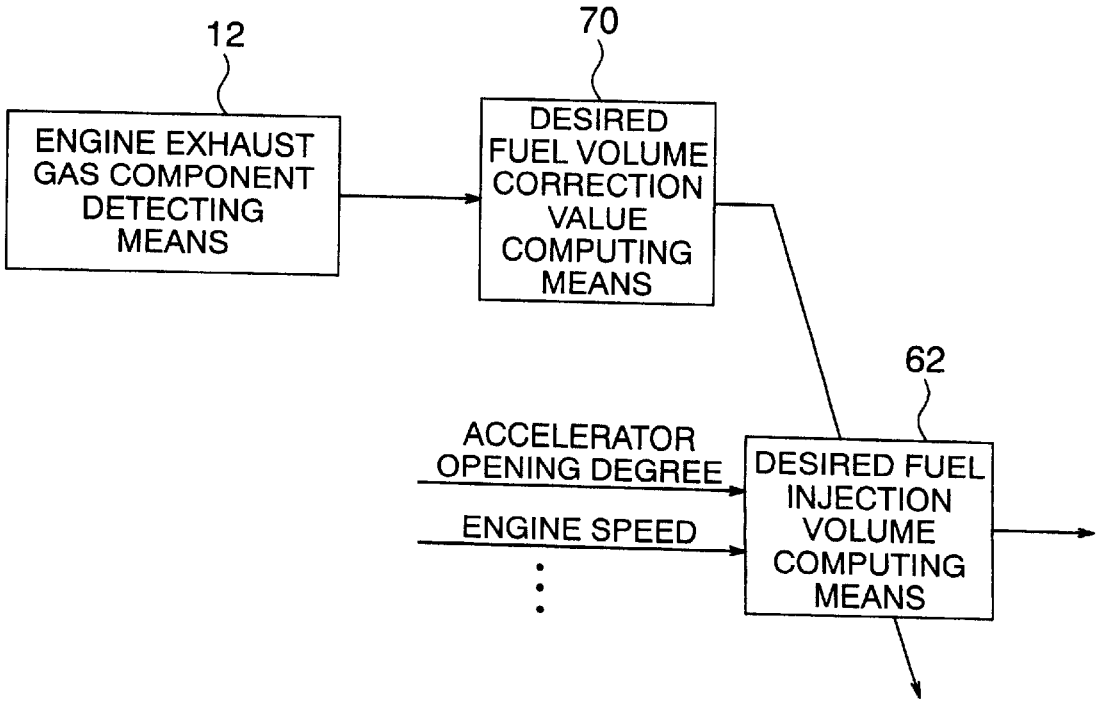
FIG. 7 is a view illustrating a control apparatus for an internal combustion engine in a seventh aspect of the present invention.
Figure 8:
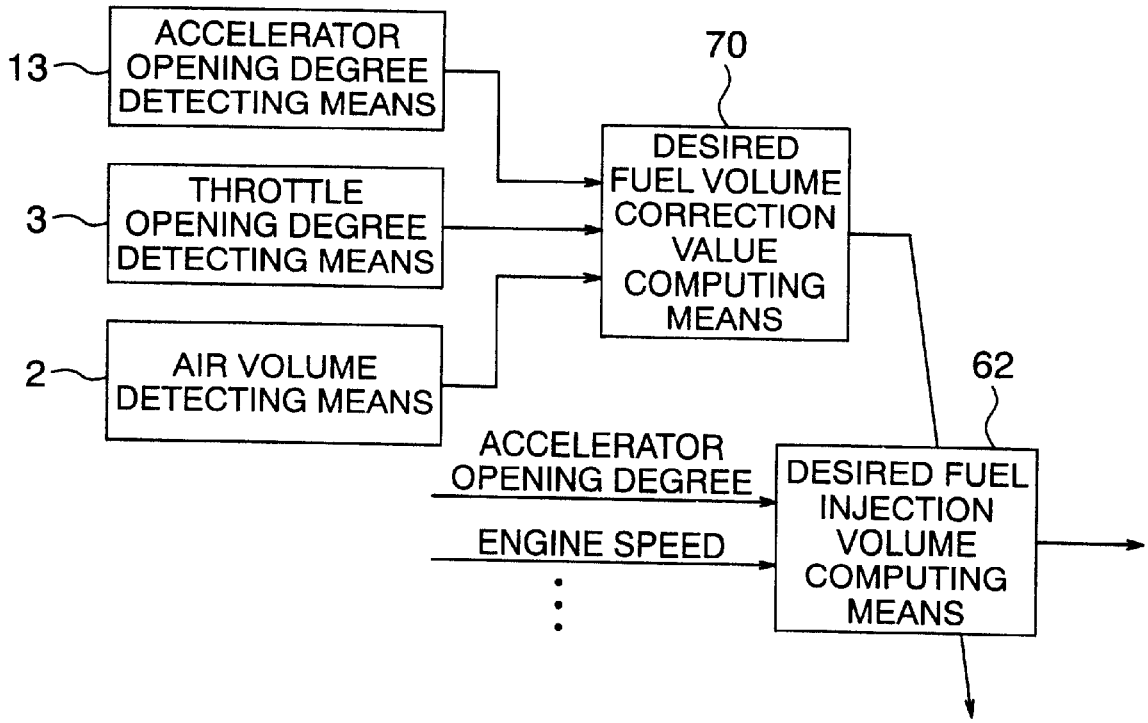
FIG. 8 is a view illustrating a control apparatus for an internal combustion engine in an eighth aspect of the present invention.
Figure 9:
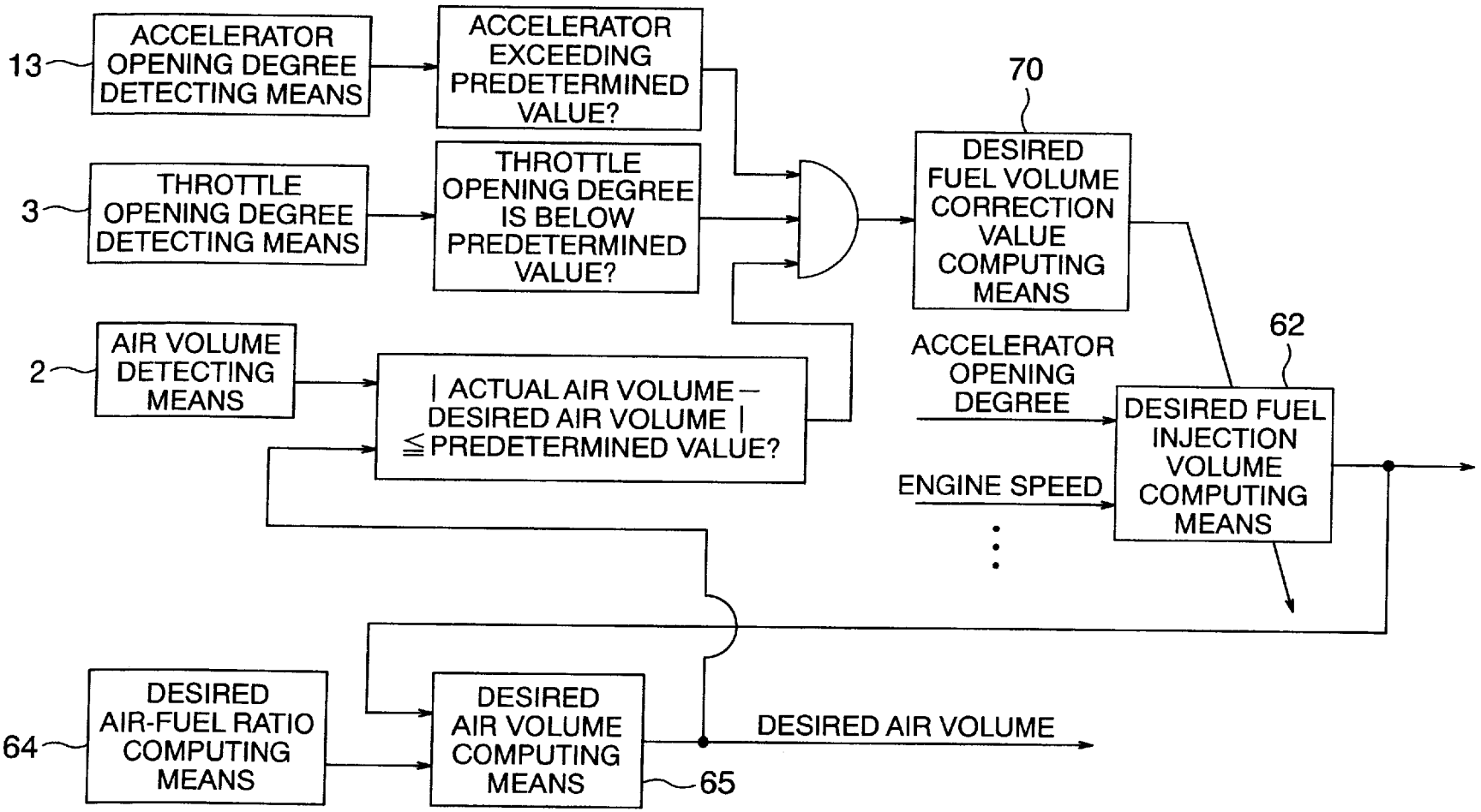
FIG. 9 is a view illustrating a control apparatus for an internal combustion engine in a ninth aspect of the present invention.
Figure 10:
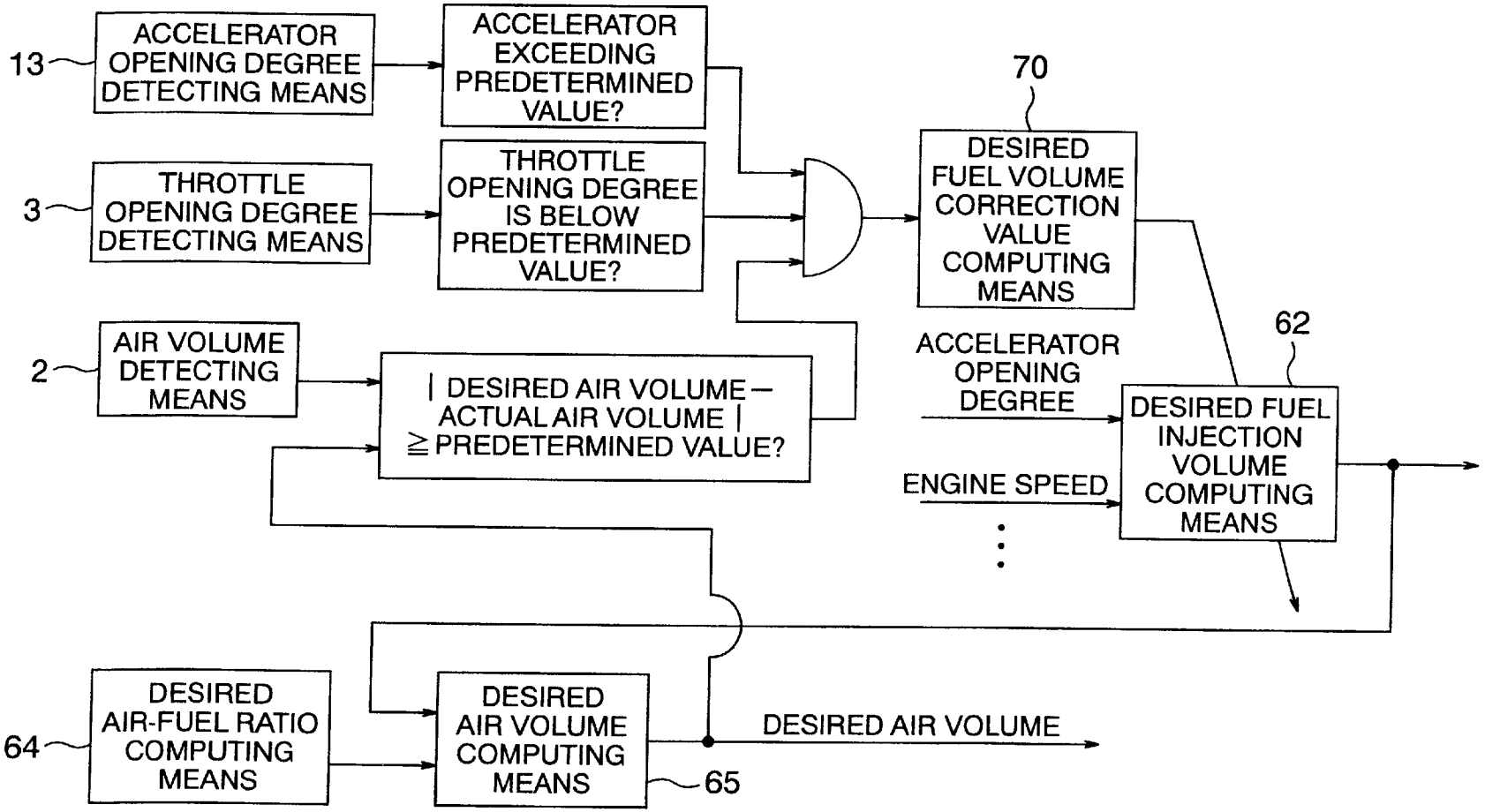
FIG. 10 is a view illustrating a control apparatus for an internal combustion engine in a tenth aspect of the present invention.
Figure 11:
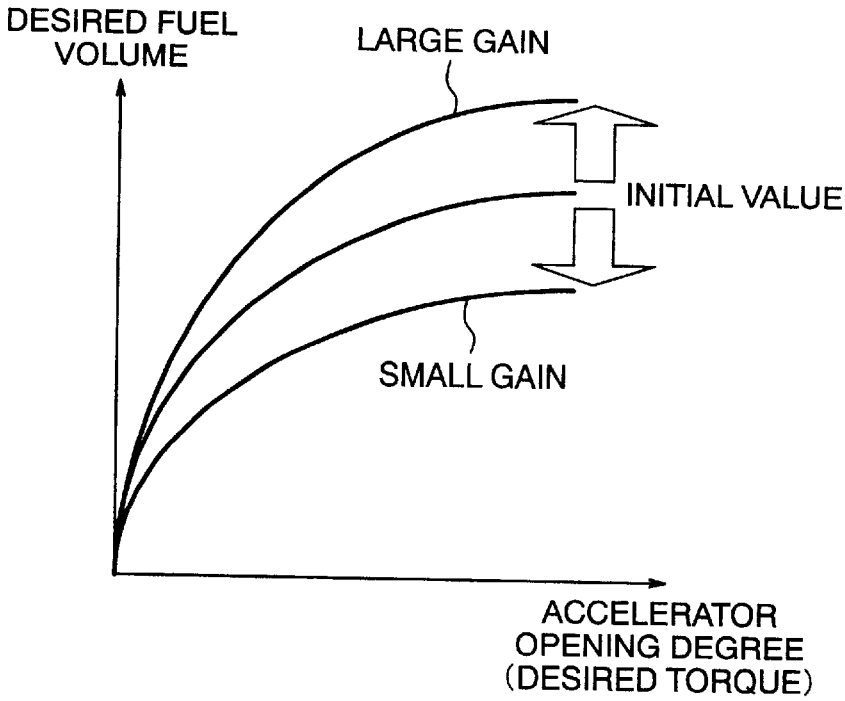
FIG. 11 is a view illustrating a control apparatus for an internal combustion engine in an eleventh aspect of the present invention.
Figure 12:
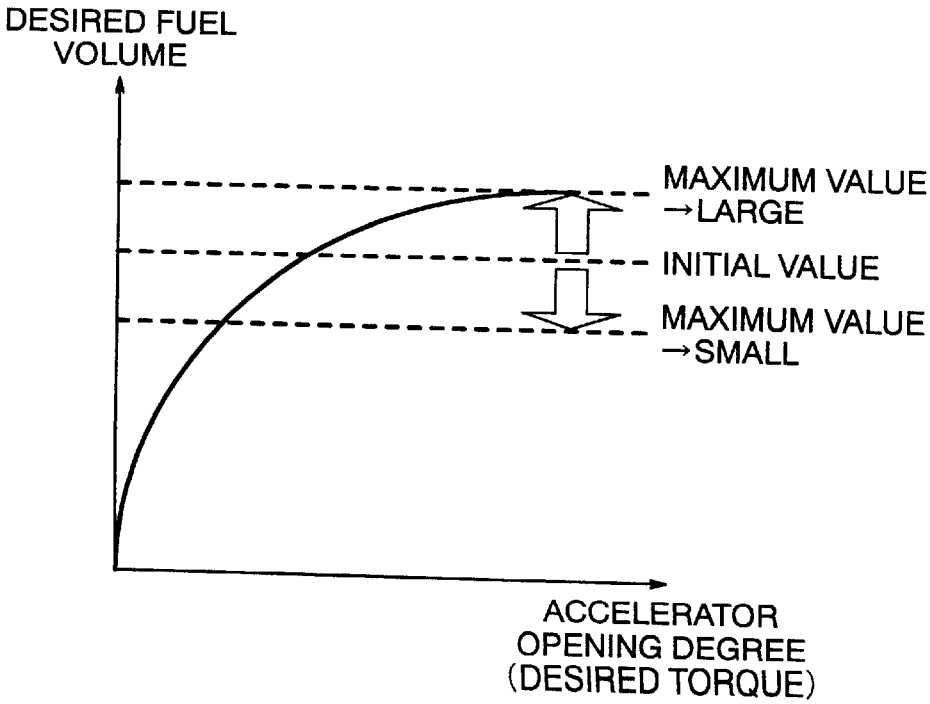
FIG. 12 is a view illustrating the control apparatus for an internal combustion engine in the eleventh aspect of the present invention.
Figure 13:
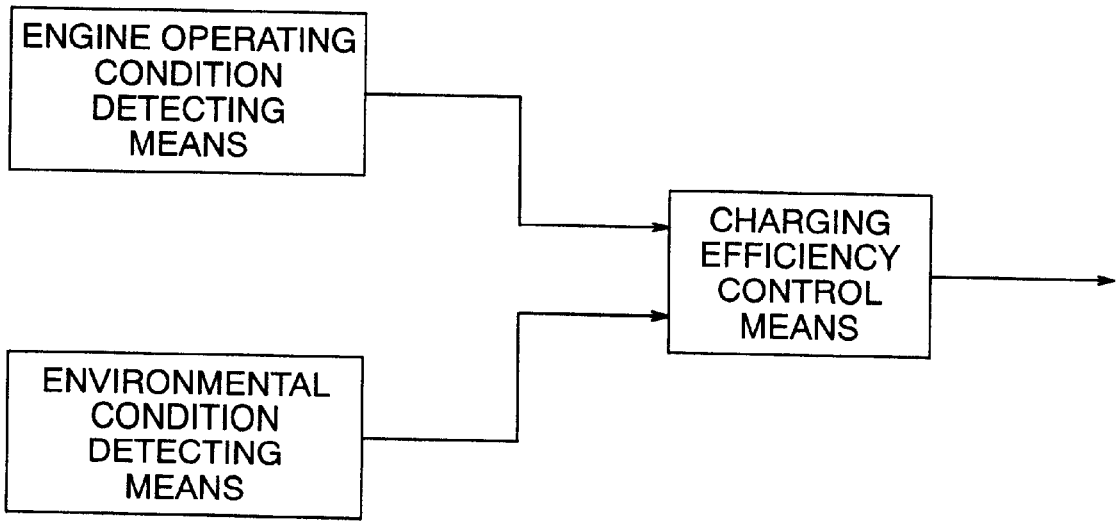
FIG. 13 is a view illustrating a control apparatus for an internal combustion engine in a twelfth aspect of the present invention.
Figure 14:
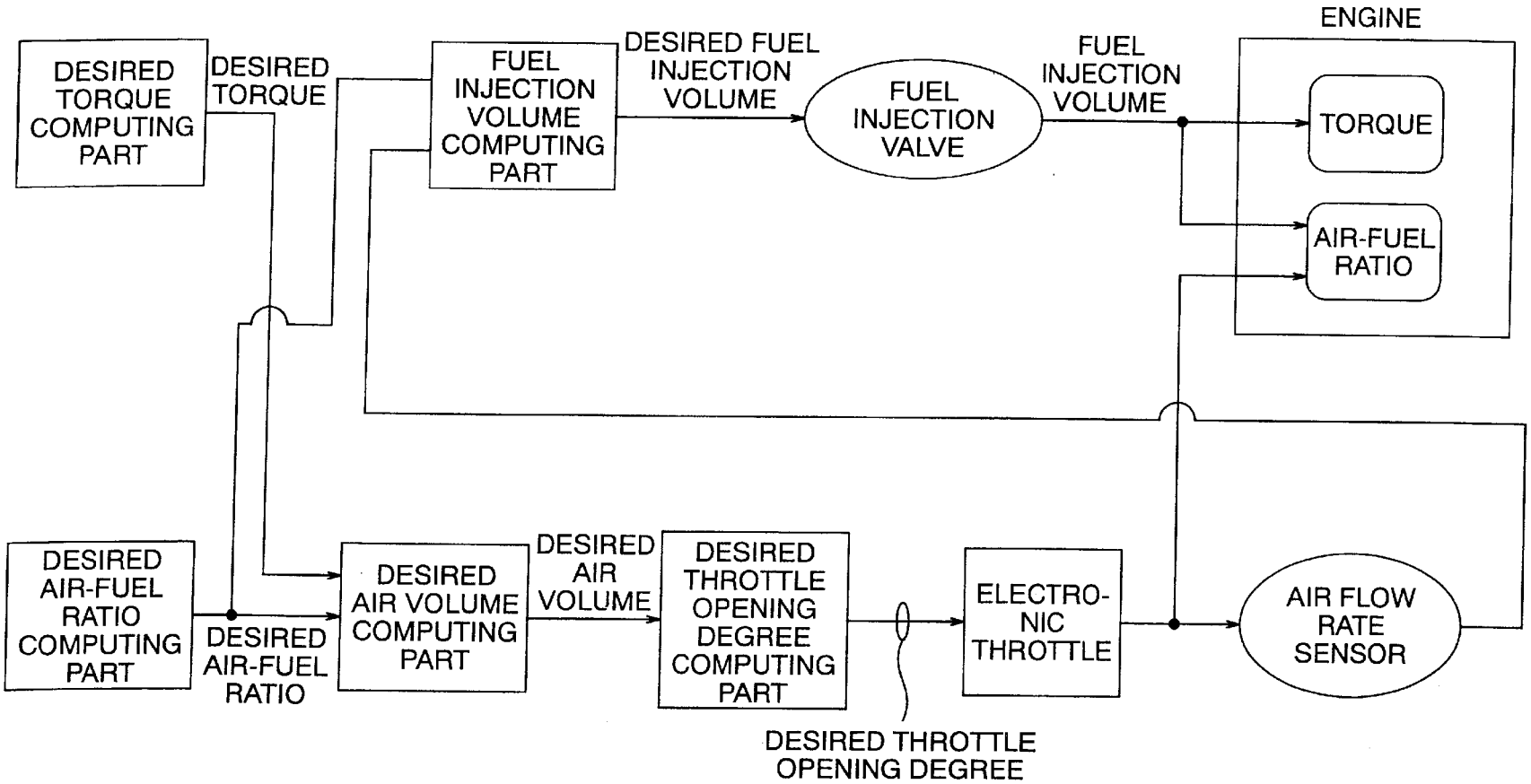
FIG. 14 is a block diagram illustrating a control apparatus for an air priority type internal combustion engine.
Figure 15:
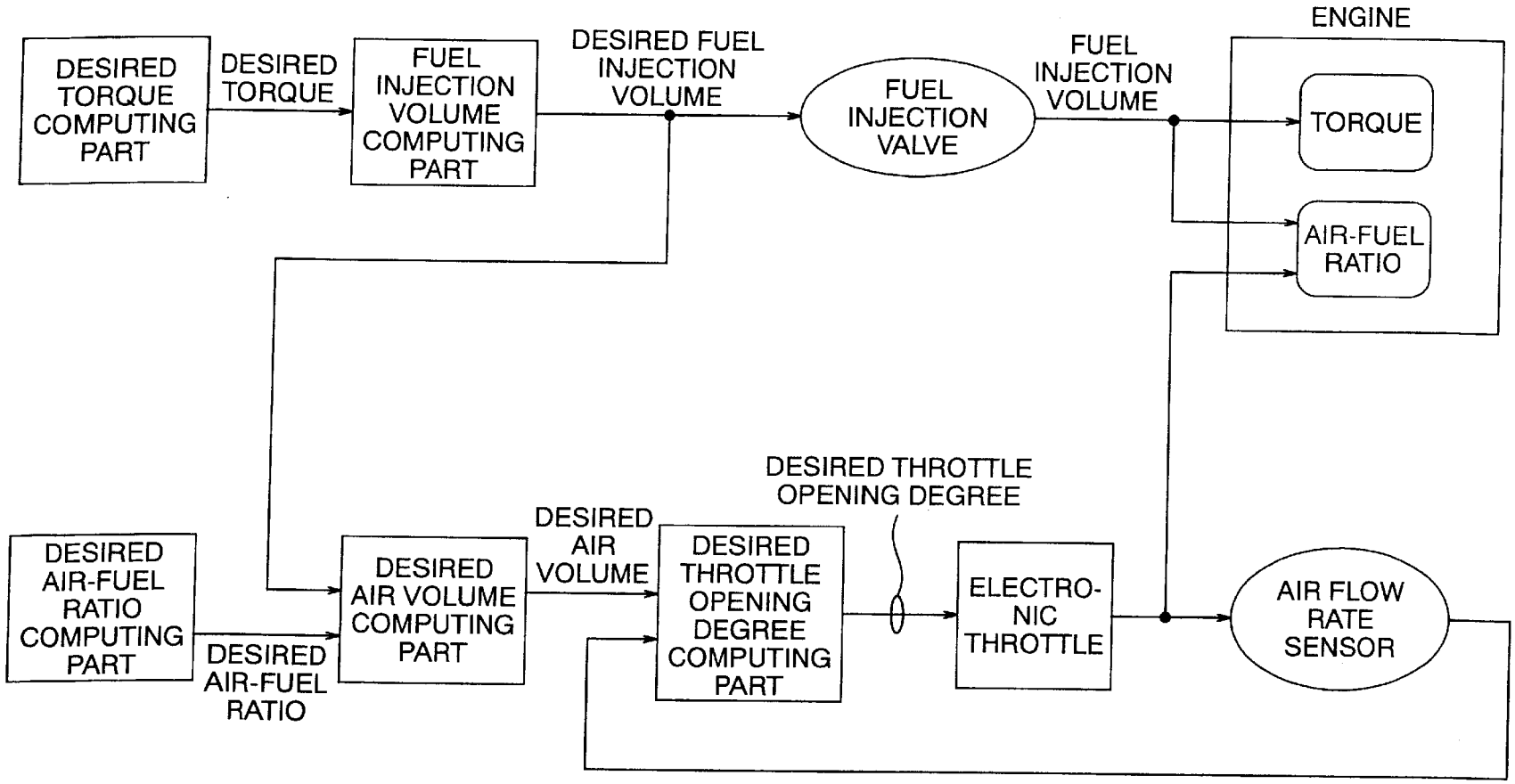
FIG. 15 is a block diagram illustrating a control apparatus for a fuel priority type internal combustion engine.
Figure 16:
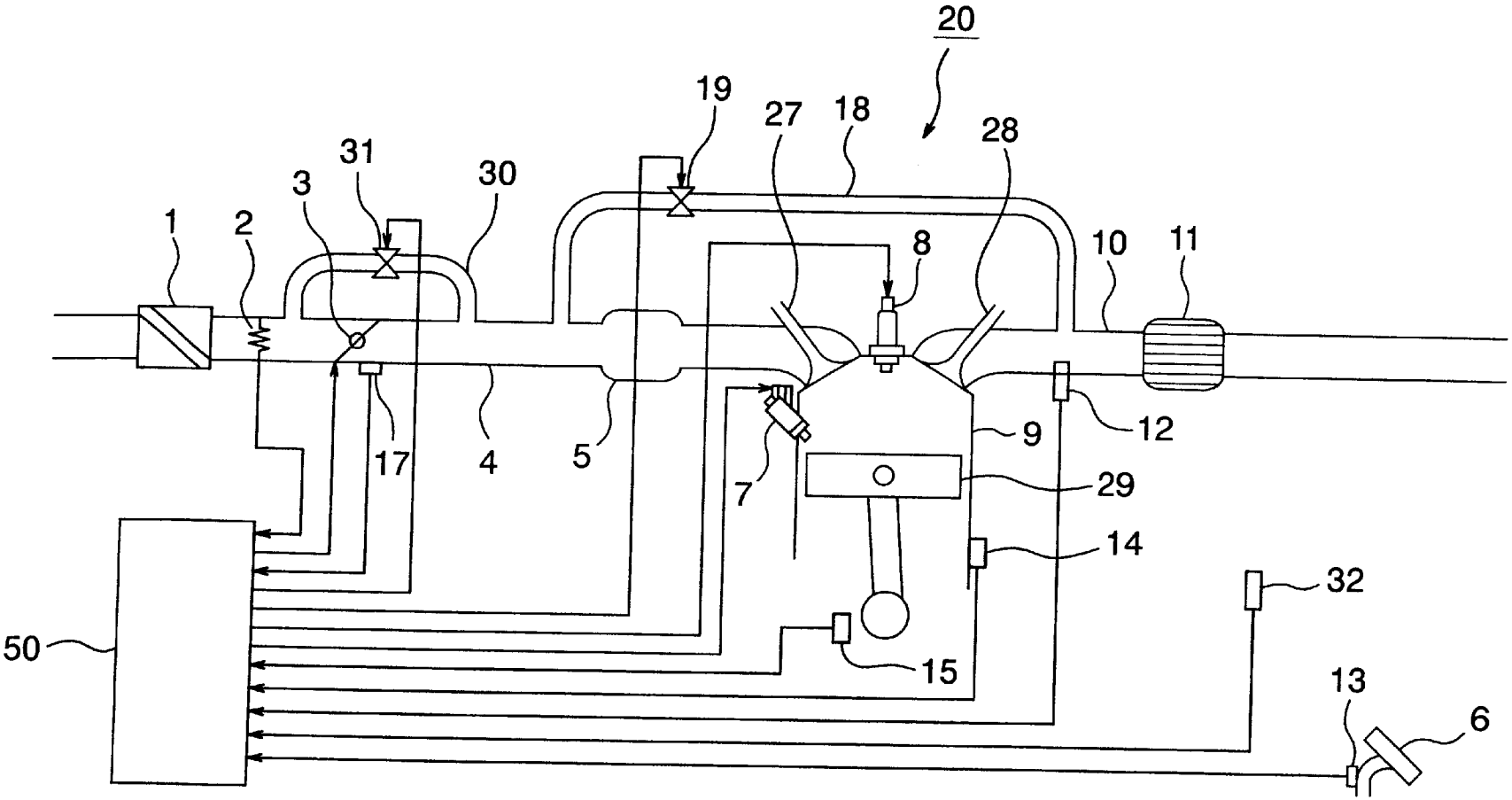
FIG. 16 is an entire configuration view illustrating a control system for an internal combustion engine system which is common to various embodiments of the control apparatus for an internal combustion engine according to the present invention.

Detailed explanation will be hereinbelow made of various embodiment of the control apparatus for an internal combustion engine according to the present invention with reference to the accompanying drawings. FIG. 16 shows an entire system for an internal combustion engine which is common to various embodiments to which the control apparatus according to the present invention is applied.

In an internal combustion engine 20 which is a cylinder injection type multi-cylinder internal combustion engine, within an intake system, air flows from the outside into an air cleaner 1, and then flows into cylinders 9 by way of an intake manifold 4 and a collector 5. The volume of the inflow air is adjusted by an electronic throttle 3, but the air volume is adjusted during idle operation by an ISC vale 31 provided in a bypass air passage 30 in order to control the speed of the internal combustion engine. Each of the cylinders 9 is attached thereto with a spark plug 8 and a fuel injection valve 7 while it is provided thereto with a lift timing control type electromagnetically driven intake valve 27 and a lift timing control type electromagnetically driven exhaust valve 29.

Further, within an exhaust system, an exhaust manifold 10 is connected to the cylinders 9, and is provided therein a lean NOx catalyst 10, and an A/F sensor 12 is attached between the cylinders 9 and ternary catalyst 11.

An exhaust gas recirculation passage (EGR passage) 18 bypassing all cylinders 9 is extended so as to communicate the intake manifold 4 and the exhaust manifold 10 with each other, and the exhaust gas recirculation passage 18 is provided therein with an EGR valve 19.

An airflow sensor 2 is located in the intake manifold 4 of the intake system, for detecting an inflow air volume, and a crank angle sensor 15 delivers a signal every one degree of rotating angle of a crank shaft. A throttle opening degree sensor 17 detects an opening degree of the electronic throttle 3, and a water temperature sensor 14 detects a temperature of cooling water in the internal combustion engine 20. An accelerator opening degree sensor 13 detects a degree of depression of the accelerator 6, and accordingly, a demand torque by the drive is detected therefrom.

Further, signals delivered respectively from the accelerator opening degree sensor 13, the air flow sensor 2, the crank angle sensor 15 and the water temperature sensor 14 are delivered to a control unit 50 which therefore obtains an operating condition of the internal combustion engine 20 from the outputs of the sensors, and accordingly, main operation factors such as an intake air volume, a fuel injection volume, an ignition timing and the like can optimumly be computed. The fuel injection volume computed in the control unit 50 is converted into a valve opening pulse signal which is then delivered to the fuel injection valve 7.

Further, in the control unit 50, a predetermined ignition timing is computed, and a drive signal is delivered to the spark plug 6. Intake air from the intake system is adjusted by the electronic throttle 3, and is then mixed with recirculated exhaust gas adjusted by the EGR valve 19. Flowing of air fed into the cylinder (combustion chamber) 9 is adjusted by the swirl control valve SCV, and then, the air flows into the cylinder 9 through the lift timing control type electromagnetically driven intake valve 27.

Fuel injected from the fuel injection valve 7 into the cylinder (combustion chamber) 9 is mixed with air flowing thereinto from the intake manifold 4 so as to form a mixture which is exploded by spark generated from the spark plug 8 with a predetermined ignition timing. A piston 29 is depressed by a combustion pressure thereby so as to drive the internal combustion engine 20. Exhaust gas after the explosion is fed into a lean NOx catalyst 11 by way of the exhaust manifold 10, exhaust components such as HC, CO, NOx, are purified through the lean NOx catalyst 11, and are discharged outside. Exhaust gas recirculated into the intake side by way of the exhaust recirculation passage 18 is controlled by the EGR valve 19.

Further, with the use of the electronic throttle 3, the lift timing control type electromagneticaly driven intake valve 27 and the lift timing control type electromagnetically exhaust valve 28, the flow rate of internally recirculated exhaust gas and the fresh air volume are controlled.

The A/F sensor 12 is attached between the cylinder 9 of the internal combustion engine 20 and the lean NOx catalyst 11, having a linear output characteristic with respect to an oxygen density contained in the exhaust gas, and since the relationship between the oxygen density in the exhaust gas and the air-fuel ratio is substantially linear, the air-fuel ratio of the internal combustion engine 20 can be obtained by the A/F sensor for detecting the oxygen density. Further, an atmospheric pressure sensor 32 is attached for detecting an atmospheric pressure.

The control unit 50 calculates an air-fuel ratio upstream of the lean NOx catalyst 11 from a signal from the A/F sensor 12, and carries out feedback control for sequentially correcting the above-mentioned basic fuel injection volume so that the air-fuel ratio of the mixture in the cylinder 9 of the internal combustion engine 20 reaches a desired air-fuel ratio.

Figure 17:
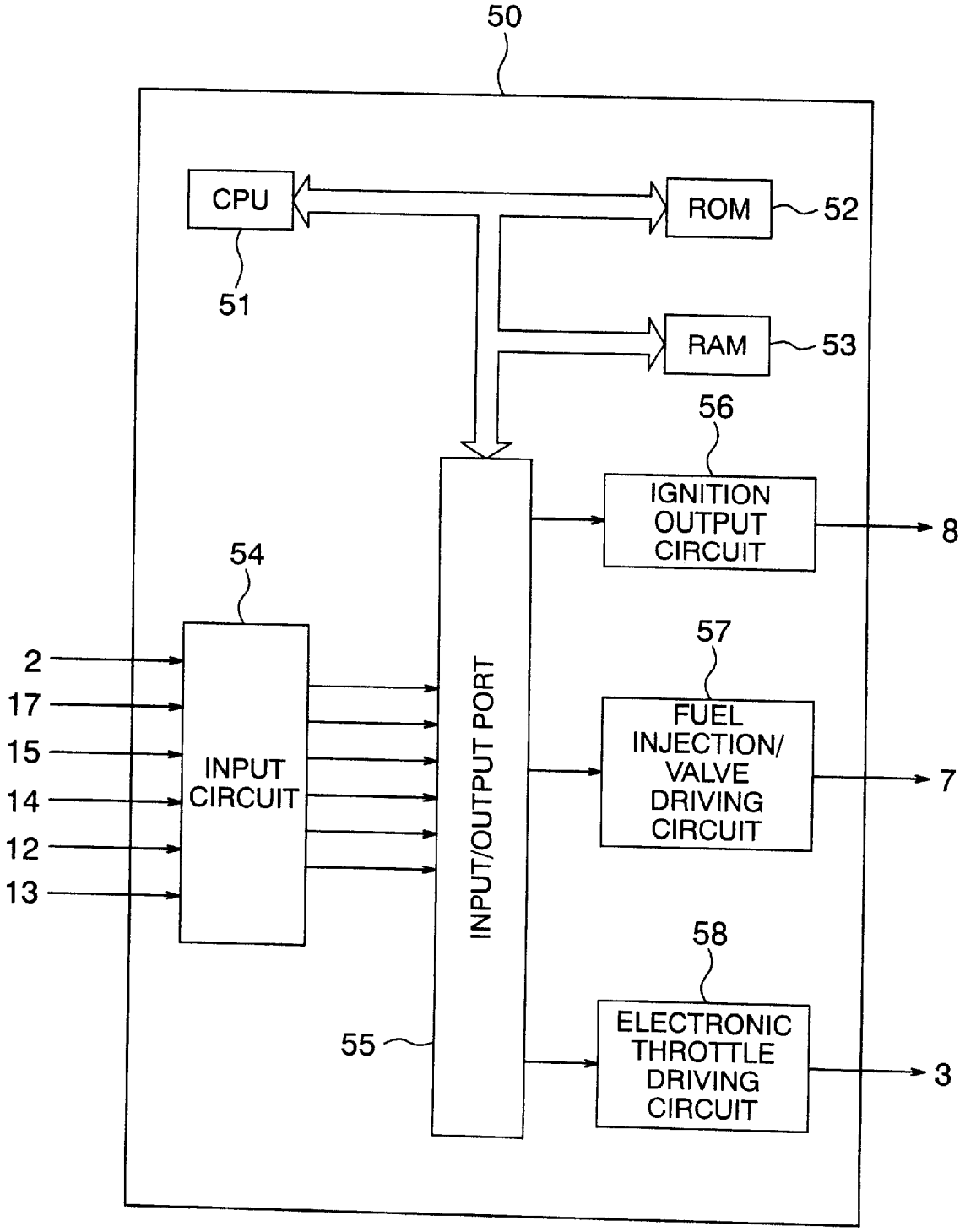
FIG. 17 is an internal configuration view illustrating a control part (control unit) of the control apparatus for an internal combustion engine.

Referring to FIG. 17 which shows an configuration of the interior of the control unit (ECU) 50 of the internal combustion engine 20 shown in FIG. 16, the ECU 50 receives output values from the various sensors, that is, the A/F sensor 12, the water temperature sensor 14, the throttle opening degree sensor 17, the air-flow sensor 2 and the internal combustion engine speed sensor 15, and carries out signal processing such as noise elimination in an input circuit 54. Then, the output values are delivered to an input/output port 55. The values at the input/output port 55 are stored in RAM 53 and are computed in a CPU 51. A control program describing the content of the computation has been written in a ROM 52.

Values exhibiting operation values of actuators, which have been computed under the control program are stored in the RAM 53, and thereafter, are delivered to the input/output port 55. Further, an actuating signal for the spark plug 8 which is used upon spark ignition and combustion is turned on upon energization of a primary coil in an ignition output circuit 56, but turned off upon deenergization thereof, that is, a turn-on signal and a turn-off signal are set. The ignition timing is the time when the turn-on is changed into the turn-off. A signal for the spark plug is amplified by an ignition output circuit 56 so as to obtain a power sufficient for the combustion, and is then delivered to the ignition plug 8.

Further, the drive signal for the fuel injection valve 7 is set to be turned on upon opening thereof and be turned off upon closing thereof, and is amplified by the fuel injection valve drive circuit 57 so as to obtain a power sufficiently opening the fuel injection valve 7 before it is delivered to the latter. The drive signal for opening the electronic throttle 2 up to a desired opening degree, is delivered to the electronic throttle 3 by way of an electronic throttle drive circuit 58.

The configuration common to various embodiments of the control apparatus for an internal combustion engine according to the present invention has been explained hereinabove. Explanation will be hereinbelow made of the respective embodiments.

[First Embodiment]

Explanation will be made of a control program written in the ROM 52 in the EPU 52.

Figure 18:
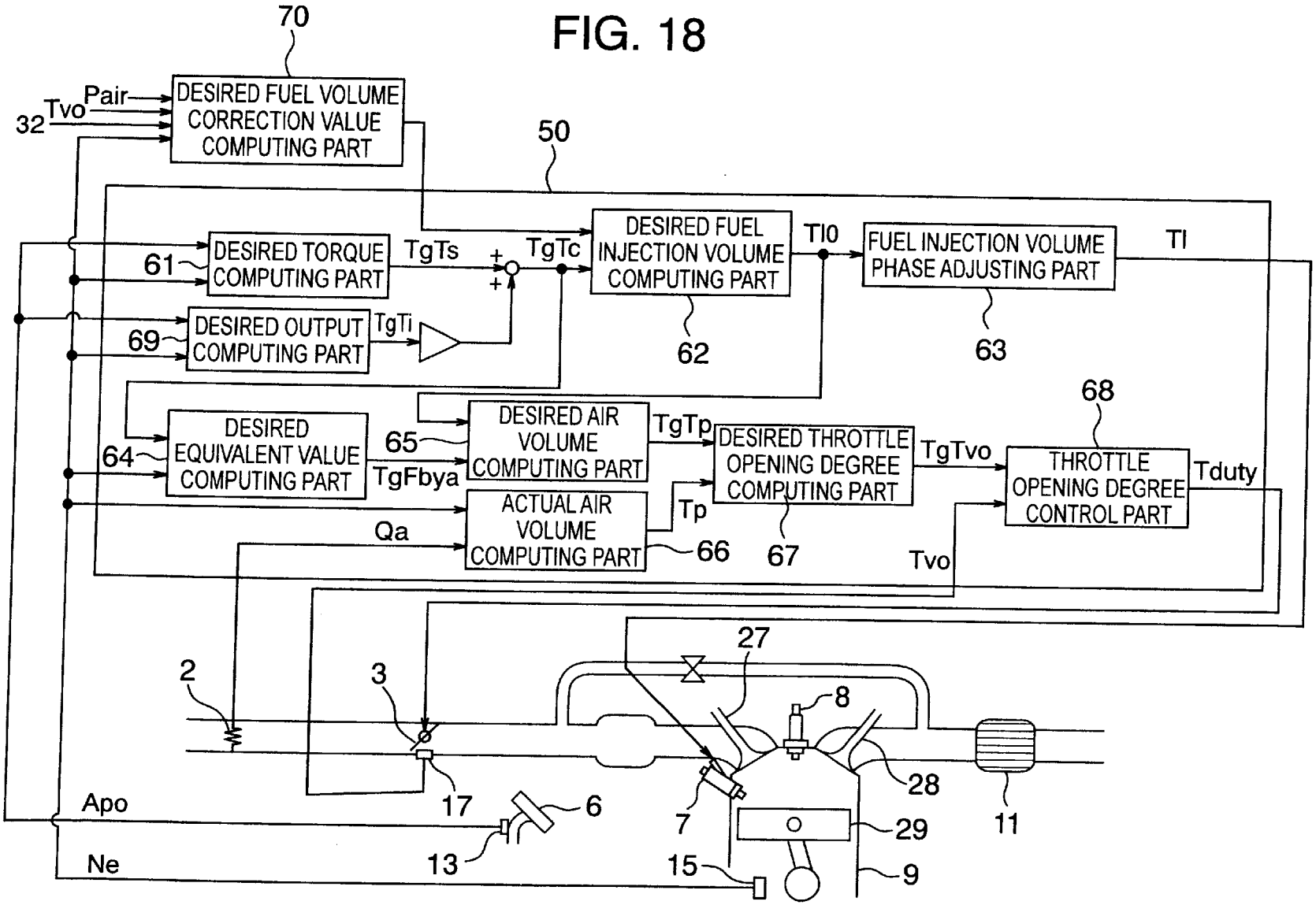
FIG. 18 is a control block diagram illustrating an entire control block diagram illustrating a control apparatus for an internal combustion engine in an embodiment of the present invention.

FIG. 18 is a control block diagram for explaining the control of the EPU 50 in the embodiment shown in FIG. 17 in its entirety, illustrating the main part of the control for a fuel priority type internal combustion engine. The control in this embodiment is composed of a desired toque computing part 61, a desired output computing part 69, a desired fuel volume correction value computing part 70, a desired fuel injection volume computing part 62, a fuel injection volume phase adjusting part 63, a desired equivalent ratio computing part 64, a desired air volume computing part 65, an actual air volume computing part 66, a desired throttle opening degree computing part 67, and a throttle opening degree control part 68.

The desired torque computing part 61 computes a torque TgTS required by the accelerator from an accelerator opening degree Apo and an internal combustion engine speed Ne, and the desired output computing part 69 computes an equivalent air flow rate TgTl for maintaining an idle speed, which has a proportional relationship to an output power of the internal combustion engine, from the accelerator opening degree Apo and the speed Ne of the internal combustion engine, and computes a desired torque TgTc from the torque TgTs required by the accelerator and the equivalent air flow rate TgTl for maintaining an idle speed. The fuel injection volume computing part 62 computes a desired fuel injection volume T10 for obtaining the desired torque TgTc. The fuel injection volume phase adjusting part 63 carries out phase correction so as to allow the fuel injection volume T10 to match with the phase of air in the cylinder 9, and computes a fuel injection volume T1 after correction.

The desired equivalent ratio computing part 64 computes a desired equivalent ratio TgFbya from the desired torque TgTc and the internal combustion engine speed Ne. The reason why the ratio between fuel and air is treated with an equivalent ratio, is that it is convenient for the computation, but it may be treated with an air-fuel ratio. It is noted that the desired equivalent ratio computing part 64 determines whether homogenous combustion or stratifying combustion are taken. The desired air volume computing part 65 computes a desired air volume Tg from the fuel injection volume T10 and the desired equivalent ratio TgFbya. The desired air-volume TgTp is a value which is conveniently normalized into an air volume flowing into one cylinder per cycle as will be explained later. The actual air volume computing part 66 converts a mass flow rate Q3 of air which is detected by the airflow sensor 2 into an actual air volume Tp flowing into one cylinder per cycle, which has the same dimension as that of the desired air-volume TgTp, and delivers the same.

The desired throttle opening degree computing part 67 computes a desired throttle opening degree TgTvo from the desired air volume TgTp and the actual air volume Tp. The throttle opening degree control part 68 computes a throttle operating value Tduty from the desired throttle opening degree TgTvo and the actual opening degree Tvo. The throttle operating value Tduty indicates a duty of a PWM signal delivered to a drive circuit for controlling current for driving a throttle motor.

Next detailed explanation will be made of control and computation parts and correction parts in the above-mentioned control block in this embodiment.

1. The Desired Torque Computing Part and the Desired Output Computing Part

Figure 19:
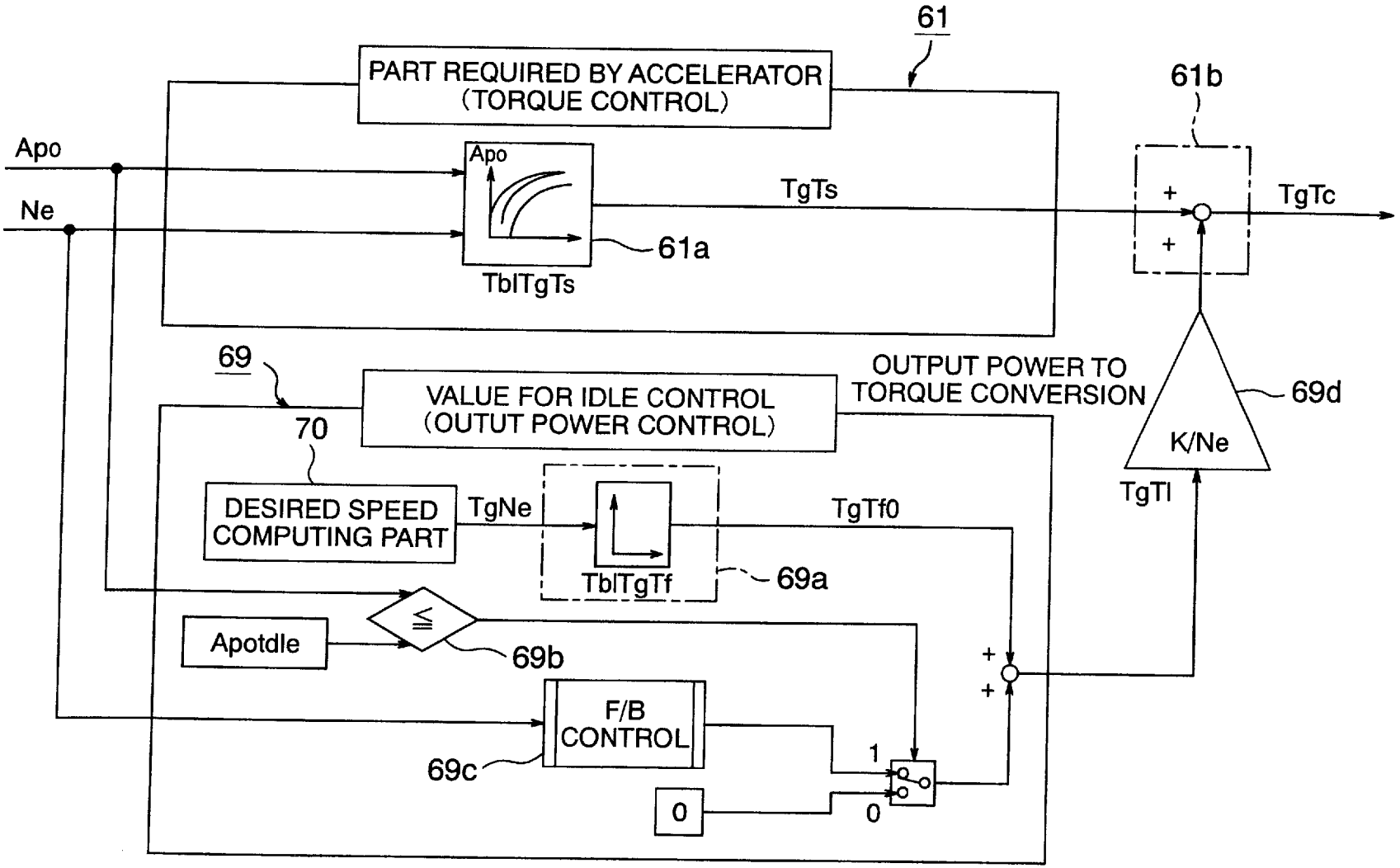
FIG. 19 is a control block diagram illustrating a computing part and a desired output computing part in the block diagram of FIG. 18.

Referring to FIG. 19 which shows the desired torque computing part 61 and the desired output computing part 69, the desired torque computing part 61 computes the torque TgTs required by the accelerator with the use of a table 61*a* between the accelerator opening degree Apo and the internal combustion engine speed Ne, and the desired output computing part 69 computes the equivalent air flow rate TgTl for maintaining an idle speed, which has a proportional relationship to the output power, that is, the value required by the accelerator and computed by the desired torque computing part 61 is for torque control, and the value for idle control, computed by the desired output computing part 69 is for output power control. The computed torque TgTs required by the accelerator is interpolated with the equivalent air flow rate TgTl so as to compute a desired combustion pressure equivalent torque TgTc.

A control part TgTf0 of idel F/F control 69*a* computed by the desired output computing part 69 is determined by referring to a table TblTgTf in view of a desired speed TgNe obtained by the desired speed computing part 70 for the internal combustion engine. An idle F/B control part 69*c* is effected during idle operation in order to correct an error in the control value of the idle F/F control 69*a*. Determination whether it is during idle operation or not is made by a determining means 69*b*, and idle operation is determined when the accelerator opening degree Apo is smaller than a predetermined value ApIIdel. The algorithm of the F/B control which will not be explained in detail, may be, for example, that of PID control. Set values on the Table TblTgTf are determined desirably from data obtained from real engines.

The operating value of idle control (the equivalent air flow rate for maintaining an idle speed) TgTl computed by the desired output computing part 69 is set to an air flow rate during stoichiometric combustion having a proportional relationship to the output power, and there is provided a mean 69*d* for dimensionally converting the output power into a torque. The dimensionally converting means 69*d* is provided with a gain K/Ne which can be determined from a flow rate characteristic of an injector (fuel injection valve).

Figure 20:
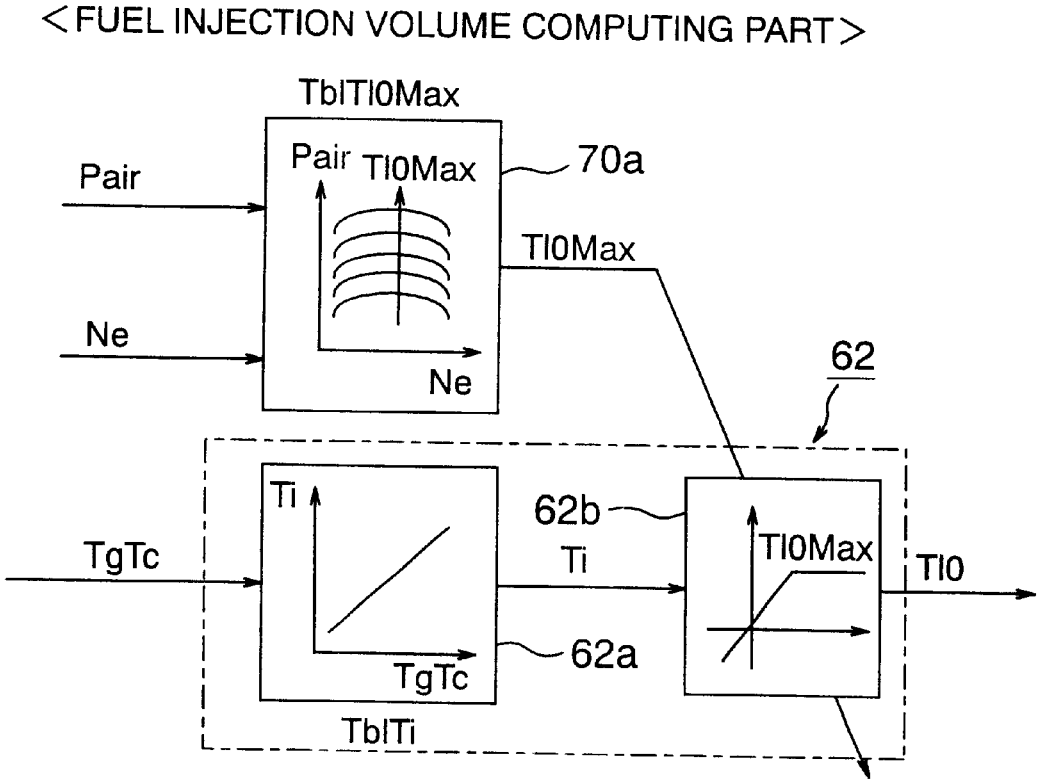
FIG. 20 is a control block diagram illustrating a fuel injection volume computing part and a fuel volume correction value computing part in the block diagram of FIG. 18.

2. The Fuel Injection Volume Computing Part and the Fuel Volume Correction Value Computing Part Referring to FIG. 20 which shows the fuel injection volume computing part 62 and the fuel volume correction value computing part 70, in the fuel injection volume computing part 62, the desired combustion pressure torque TgTc is converted into a basic fuel injection volume Ti by a basic fuel injection volume computing part 62*a* with the use of a table TblTi. It is noted here that the basic fuel injection volume Ti is a fuel injection volume in one cylinder per cycle, and accordingly, the basic fuel injection volume Ti is in proportion to a torque. With the use of this proportional relationship, the desired combustion pressure torque TgTc is converted into the basic fuel injection volume Ti.

Further, the basic fuel injection volume Ti is limited with the use of an upper limit value of the basic fuel injection volume by an upper limit value limiter 62, and thereafter, a fuel injection volume TI0 is computed. The upper limit value TIOMax of the basic fuel injection volume is computed by a fuel volume upper limit value computing part 70*a* which corresponds one-to-one to the fuel volume correction value computing part 70 by referring to a table TblTIOMax in view of an atmospheric pressure Pair and the internal combustion engine speed Ne. The atmospheric pressure Pair is detected by the atmospheric pressure sensor 32. That is, the maximum value of the fuel injection volume is adjusted in accordance with a maximum value of the air volume in the cylinder per internal combustion engine speed with the use of the atmospheric pressure Pair.

Figure 27:
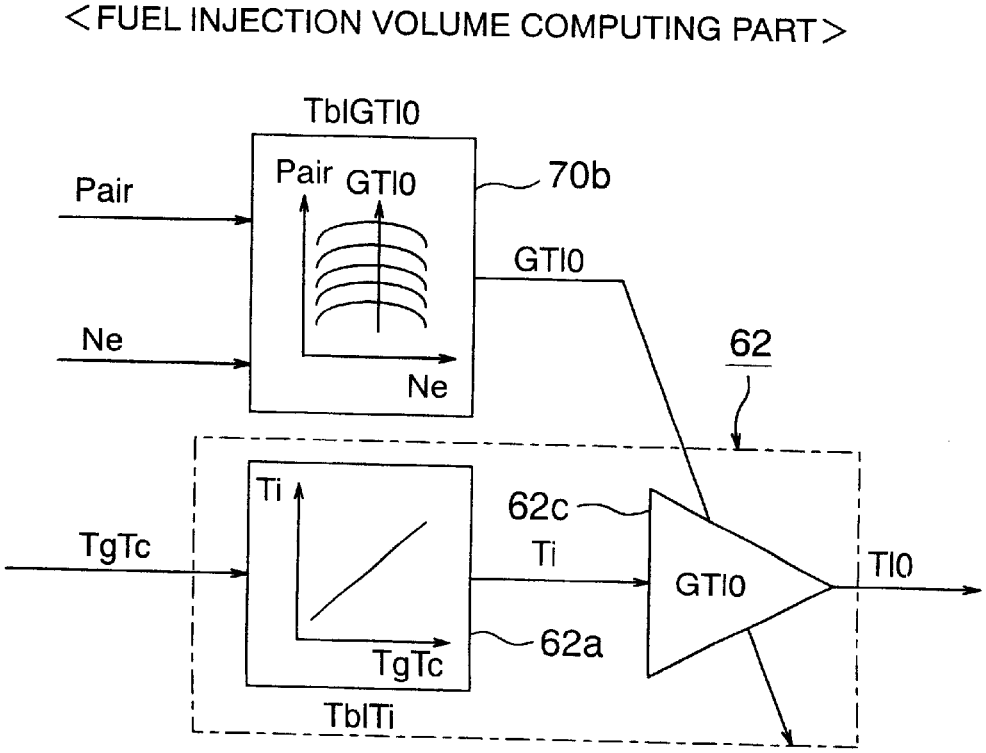
FIG. 27 is a control block diagram illustrating a fuel injection volume computing part and a fuel volume correction value computing part in the block diagram of FIG. 18.

Further, as to the means for adjusting the fuel injection volume in accordance with the atmospheric pressure Pair, as shown in FIG. 27, the basic fuel injection volume TI0 may be multiplied by the gain GT10 by the converting part 62*c* so as to be converted into the fuel injection volume TI0. It is noted here that the gain G10 is the value which is computed by the fuel volume correction value computing part 70*b* in reference to a table TbleGI0 in view of the atmospheric pressure Pair and the internal combustion engine speed Ne. Set values on the table TblTIOMax, and the table TblGTI0 are desirably determined from data obtained from real engines.

3. The Fuel Injection Volume Phase Adjusting Part

Figure 21:
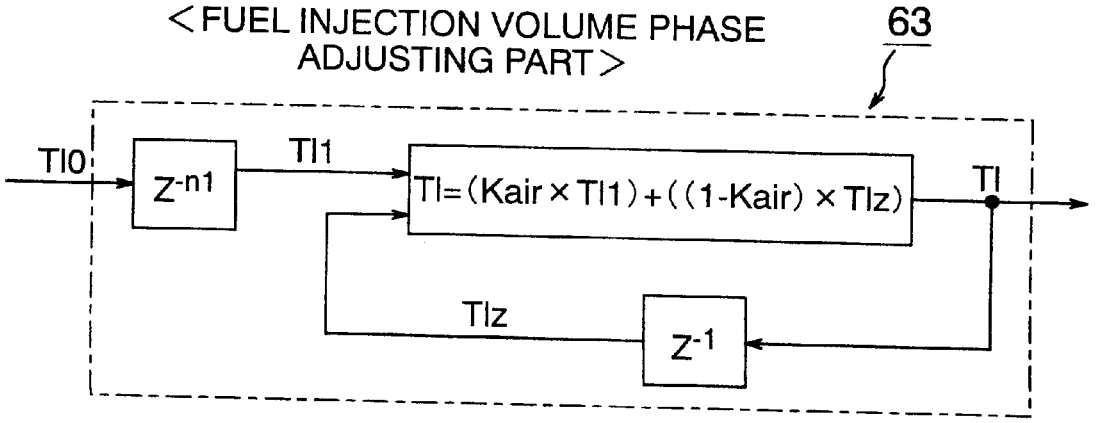
FIG. 21 is a control block diagram illustrating a a fuel injection volume phase adjusting part in the block diagram of FIG. 18.

Referring to FIG. 21 which shows the desired fuel injection volume phase adjusting part 63 which carries out correction in order to adjust the fuel injection volume TI0 to a phase of air in the cylinder 9. The air transmission characteristic from the throttle to the cylinder is approximated by a dead time+a first-order lag system. Set values for a parameter nl indicating the dead time and a parameter Kair corresponding to a time constant of the first-order time lag system are desirably determined by data obtained from real engines. Further, the parameter nl and the parameter Kair may be changed depending upon various operating conditions.

4. The Desired Equivalent Ratio Computing Part

Figure 22:
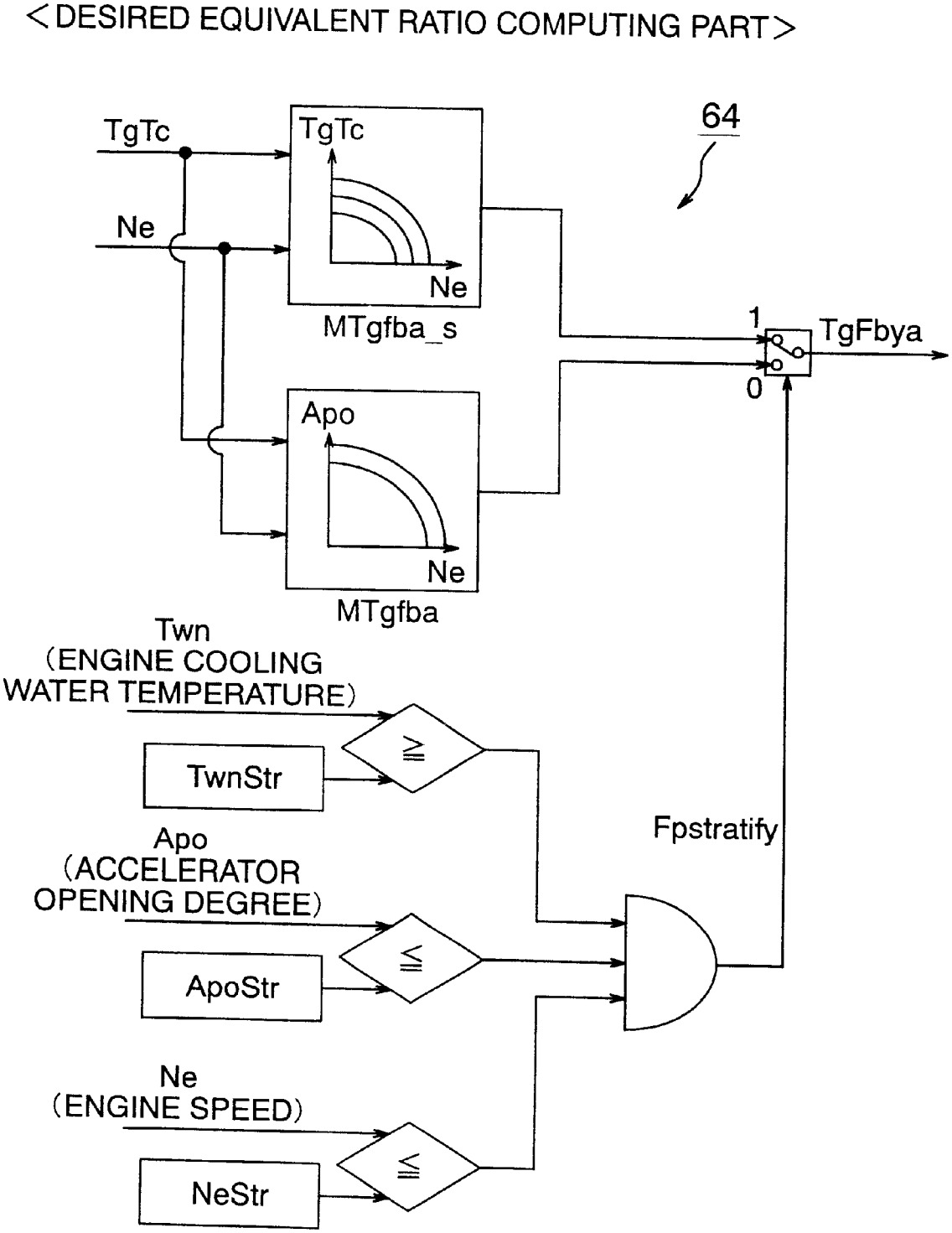
FIG. 22 is a control block diagram illustrating a desired equivalent ratio computing part in the block diagram of FIG. 18.

Referring to FIG. 22 which shows the desired equivalent ratio computing part 64, this determines a combustion condition and computes a desired equivalent ratio. When a stratifying combustion allowance flag Fpstratify is Fpstratify=1, the injection timing, the ignition timing, the fuel injection volume and the air volume are controlled. It is noted that determination of the injection timing and the ignition timing will not be explained in detail. Fpstratify is set to 1 whenever values of a water temperaure Twn, an accelerator opening degree Apo and the engine speed Ne satisfy conditions, and accordingly, stratifying condition is allowed.

Upon allowance of the stratify combustion, a value obtained by referring to a desired equivalent ratio map Mtgfba#s for stratifying combustion, in view of the desired combustion torque TgTc and the engine speed Ne is set as the desired equivalent ratio TgFbya. If TGFbya=0, homogenous combustion is set, and a value obtained by referring to a desired equivalent ratio map Mtgfba for homogenous combustion in view of the desired combustion torque TgTc and the engine speed Ne is set as the desired equivalent ratio TgFbya. Set values on the desired equivalent ratio map Mtgfba#s and the desired equivalent ratio map Mtgfba are preferably determined by data obtained from real engines.

5. The Desired Air Volume Computing Part

Figure 23:
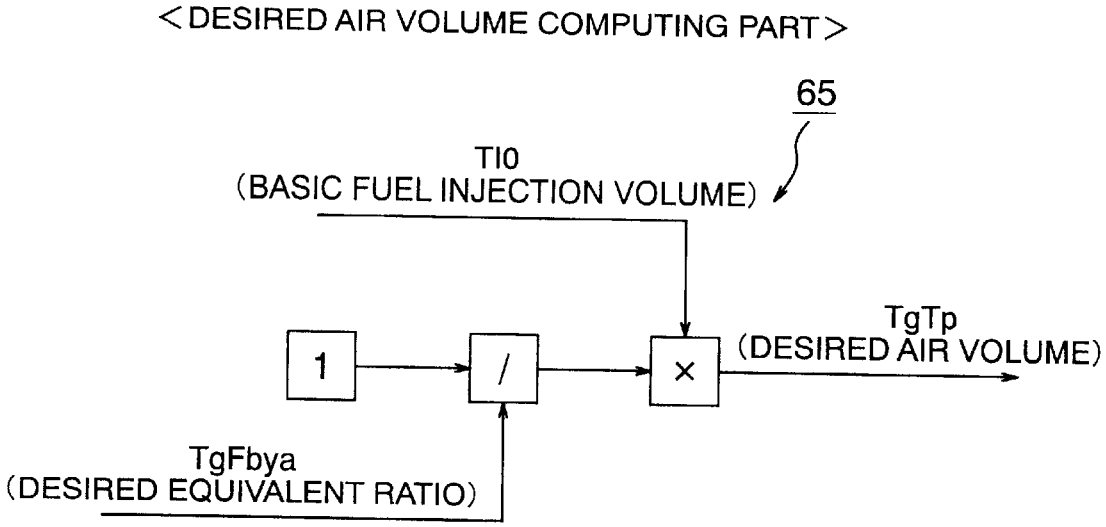
FIG. 23 is a control block diagram illustrating a desired air volume computing part in the block diagram of FIG. 18.

Referring to FIG. 23 which shows the desired air volume computing part 65, this computes the desired air volume TgTp. Conveniently, the desired air volume TgTp is computed as a value which is normalized into an air volume flowing into one cylinder per cycle. As shown in FIG. 23, the desired air volume TgTp is computed from the fuel injection volume TI0 and the desired equivalent ratio Gfbya with the use of the following formula:

$$TgTp=TI0\times(1/TgFbya)$$

6. The Actual Air Volume Computing Part

Figure 24:
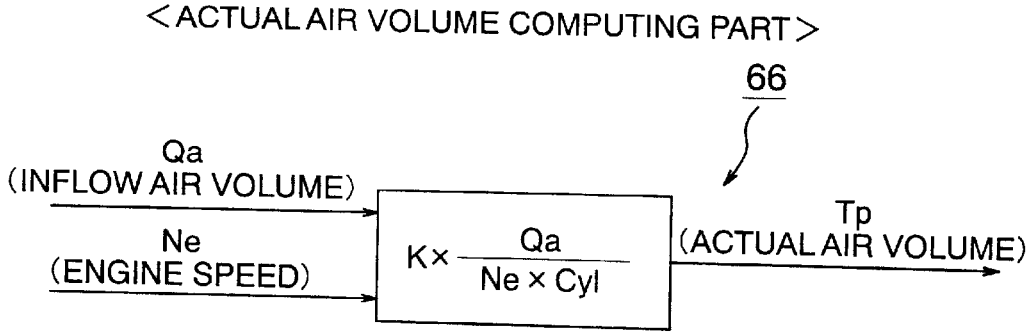
FIG. 24 is a control block diagram illustrating an actual air volume control part in the block diagram of FIG. 18.

Referring to FIG. 24 which shows the actual air volume computing part 66, this computes the actual air volume Tp. Conveniently, as shown in FIG. 24, the actual air volume Tp is computed as a value which is normalized into an air volume flowing into one cylinder per cycle. It is noted here that Qa is an air flow rate detected by the air flow sensor 2, and K is determined so that the actual air volume Tp becomes the fuel injection volume during operation with a theoretical air-fuel ratio. Further, Cyl is a number of cylinders in the internal combustion engine.

7. Desired Throttle Opening Degree Computing Part

Figure 25:
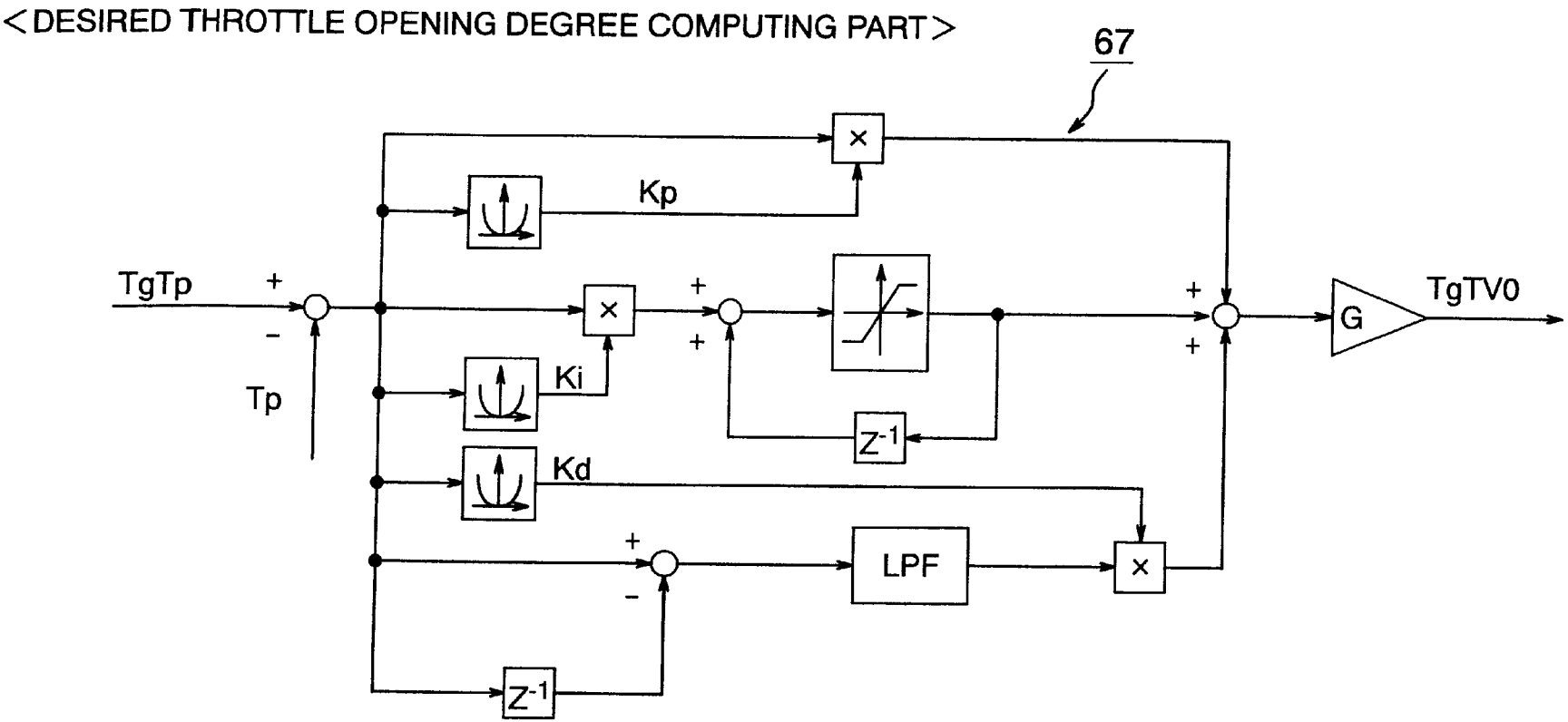
FIG. 25 is a control block diagram illustrating a desired throttle opening degree computing part in the block diagram of FIG. 18.
Figure 26:
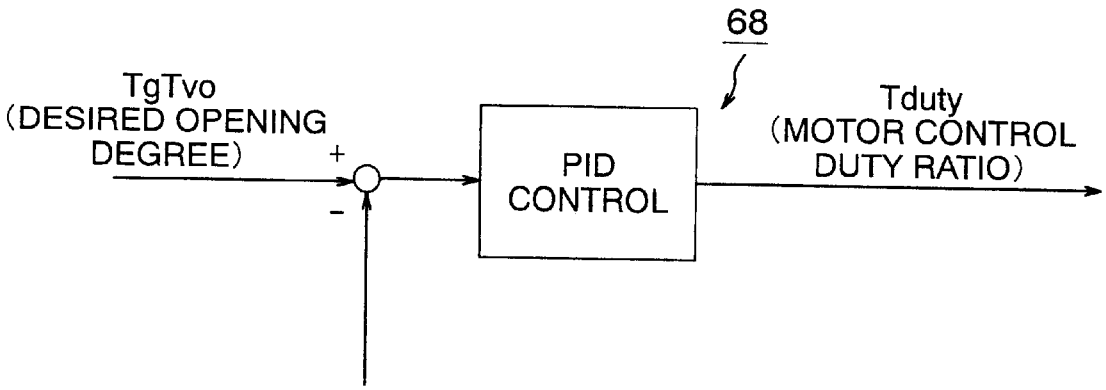
FIG. 26 is a control block diagram illustrating a throttle opening degree control part in the block diagram of FIG. 18.

Referring to FIG. 25 which shows the desired throttle opening degree computing part 67, this computes a desired throttle opening degree TgTVO from the desired air volume TgTp, the actual air volume Tp and the engine speed Ne. The desired throttle opening degree computing part 67 consists of a part for obtaining a desired throttle opening degree TgTVOFF under F/F from the desired air volme TgTp and the engine speed Ne, and a part for obtaining a desired throttle opening degree TgTVOFB from the desired air volume TgTp and the actual air volume Tp. The F/F control part is adapted to obtain TgTVOFF with reference to a map as shown in FIG. 26. Set values on the map are desirably obtained by data from actual engines. The F/B control is made through PID control. Gains are obtained depending upon a deviation between TgTp and Tp, but specific set values thereof are preferably obtained by data from real engines. An LPF (low pass filter) is provided for a D part in order to remove high frequency noise. The sum of the desired throttle opening degree TgTVOFF computed under the F/F control and the desired throttle opening degree TgTVOFB computed under the F¥B control is set to a final desired throttle opening degree.

8. The Throttle Opening Control Part

Referring to FIG. 26 which shows the throttle opening degree control part 68, this computes an operating value Tduty for driving the throttle, from the desired throttle opening degree TgTVO and the actual throttle opening degree Tvo. It is noted as mentioned above that the operating value Tduty for driving the throttle indicates a duty ratio of a PWM signal delivered to the drive circuit 58 for controlling current for driving the throttle motor. In this embodiment, the operating value Tduty for driving the throttle is obtained from the PID control. Although no detailed explanation will be made, gains for the PID control are desirably tuned to optimum values with the use real engines.

[Second Embodiment]

This embodiment relates to a control apparatus in which a charging efficiency of the air volume in the cylinder of the internal combustion engine 20 is indirectly detected from opening and closing timing of the variable intake and exhaust valves 27, 28, and the fuel supply volume is adjusted.

The control apparatus for an internal combustion engine in this embodiment is the same as the control apparatus for an internal combustion engine in the first embodiment, except the fuel injection volume computing part 62 and the fuel volume correction value computing part 70, and accordingly, the explanation thereof of will be omitted.

2. The Fuel Injection Volume Computing Part and the Fuel Volume Correction Value Computing Part Referring to FIG. 28 which shows the fuel injection volume control part 62 and the fuel volume correction value computing part 70 (70*c*), the fuel injection volume computing part 62 converts the desired combustion pressure torque TgTc into the basic fuel injection volume Ti with the use of a table TbleTi. It is noted here that the basic fuel injection volume Ti is a fuel injection volume for one cylinder per cycle, and accordingly, the basic fuel injection volume Ti is in proportion to the toque. With the use of this proportional relationship, the desired combustion pressure torque TgTc is converted into the basic fuel injection volume Ti.

Figure 28:
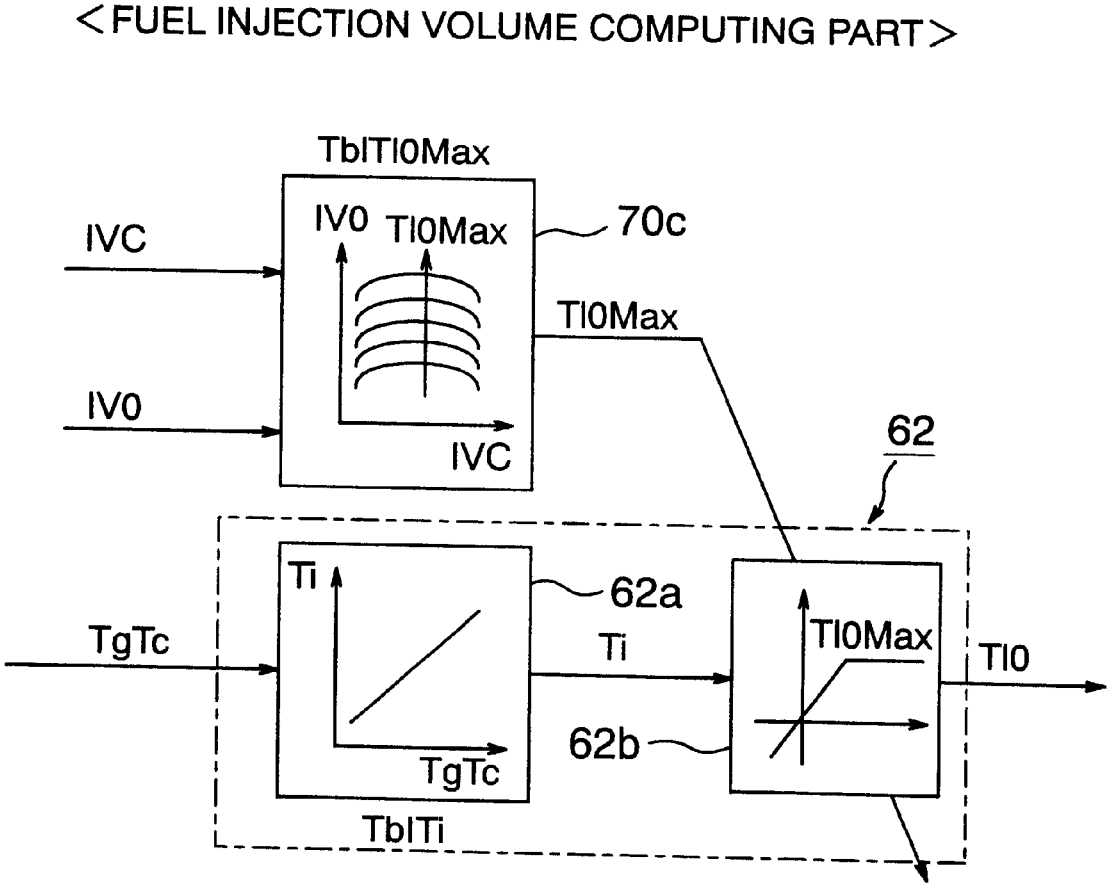
FIG. 28 is a control block diagram illustrating a fuel injection volume computing part and a fuel volume correction value computing part in a second embodiment of the control apparatus for an internal combustion engine according to the present invention.

Further, as shown in FIG. 28, the basic fuel injection volume Ti is limited to the upper limit value TI0Max of the basic fuel injection volume by the upper limiter 62*a*, and thereafter, a basic fuel injection volume TI0 is computed. The upper limit value TI0Max of the baic fuel injection volume is a value obtained by referring to a map TblTI0Max in a fuel injection volume correcting part 70*c* in view of an opening timing IVC and a closing timing IVO of the electromagnetically driven intake valve 27. That is, the maximum value of the fuel injection volume is adjusted in accordance with a maximum value of air volume in the cylinder which varies by the opening timing IVC and the closing timing IVO of the electromagnetically driven intake valve 27.

Figure 29:
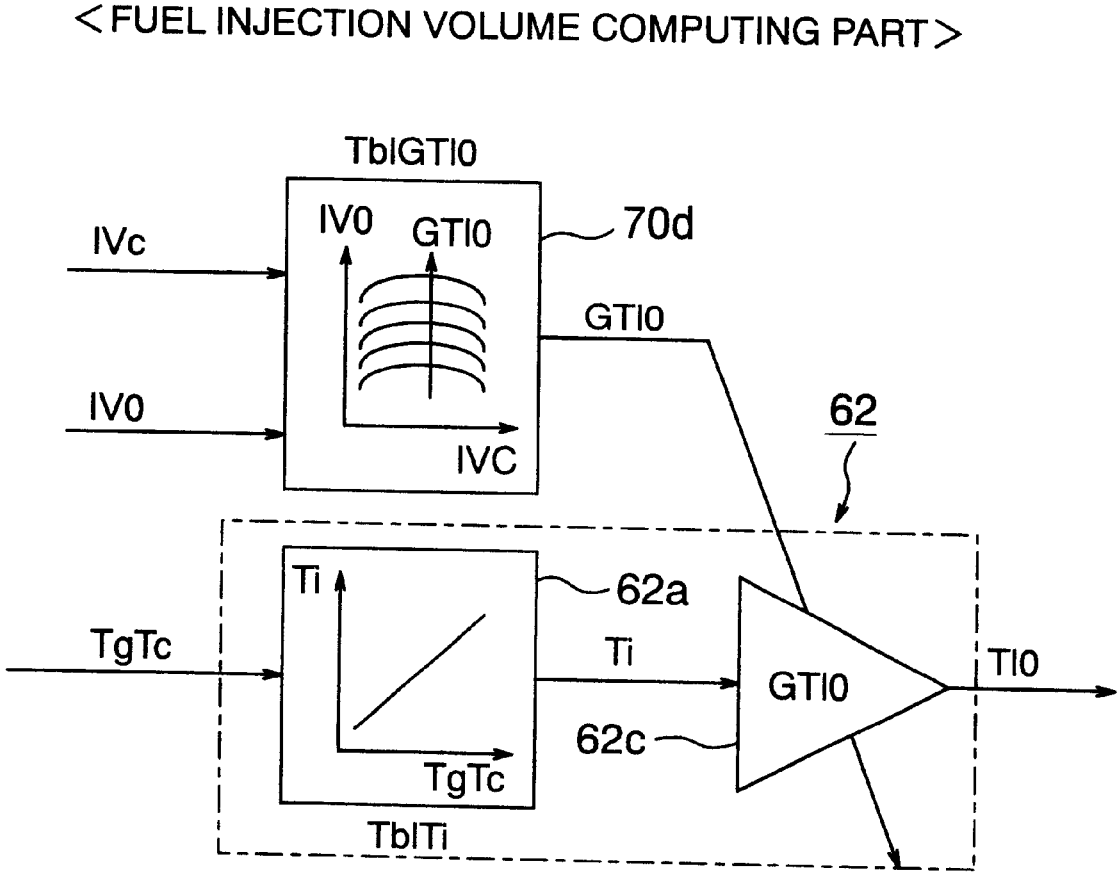
FIG. 29 is another control block diagram illustrating a fuel injection volume computing part and a fuel volume correction value computing part in the second embodiment of the control apparatus for an internal combustion engine according to the present invention.

Further, as shown in FIG. 29, the converting part 62*c* may multiply the basic fuel injection volume Ti by a gain GTI0 in order to covert it into the fuel injection volume TI0. The gain GTI0 is a value which is computed by a fuel injection volume correction value computing part 70*b* with reference to the map TblGTI0 in view of the opening timing TIV and the closing timing TIO of the electromatnically driven intake valve 27.

Figure 30:
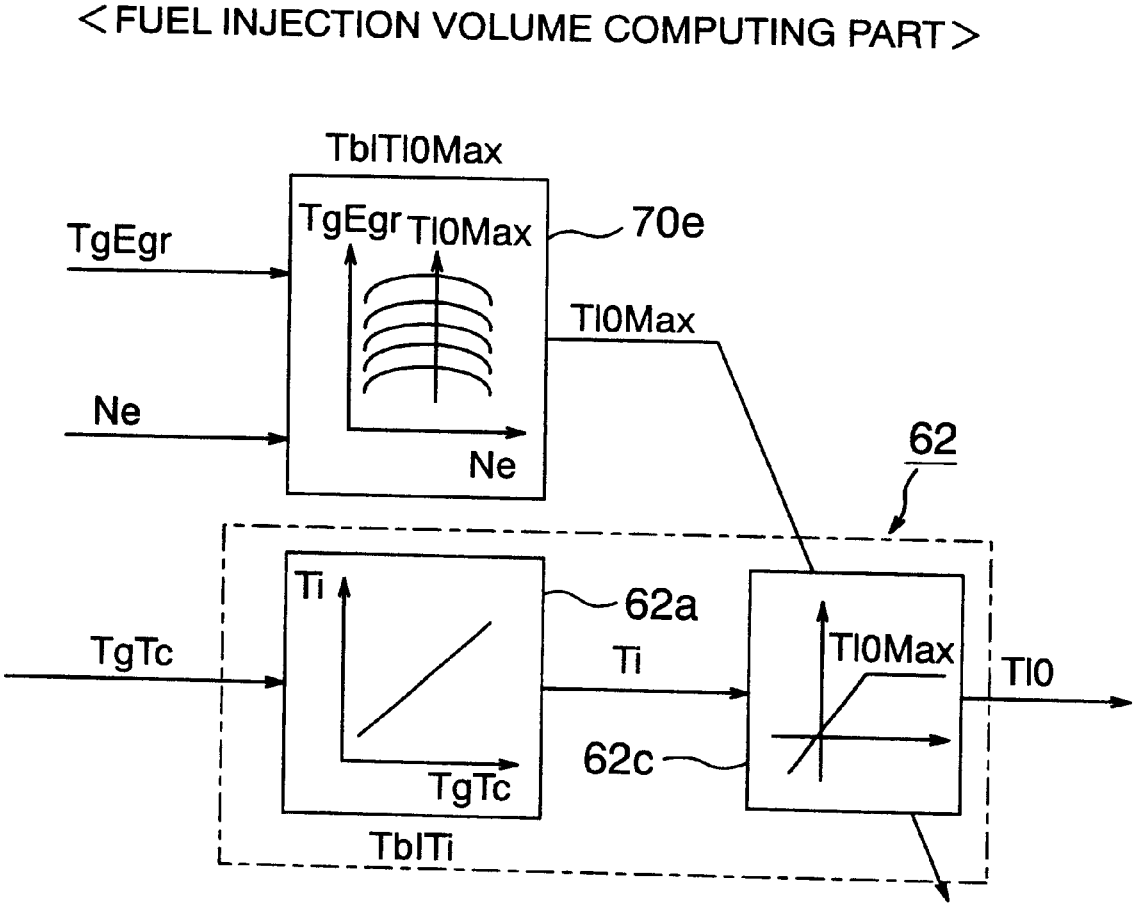
FIG. 30 is further another control block diagram illustrating a fuel injection volume computing part and a fuel volume correction value computing part in the second embodiment of the control apparatus for an internal combustion engine according to the present invention.
Figure 31:
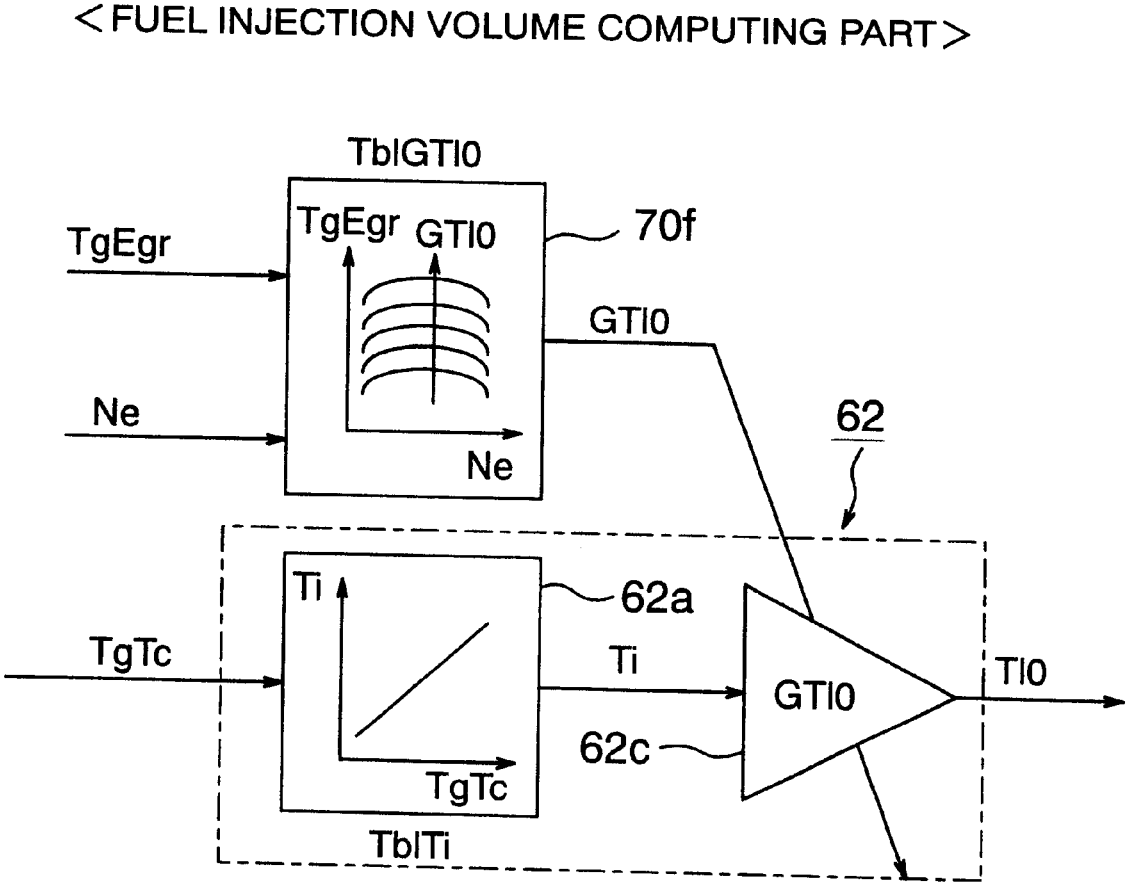
FIG. 31 is further another control block diagram illustrating a fuel injection volume computing part and a fuel volume correction value computing part in the second embodiment of the control apparatus for an internal combustion engine according to the present invention.

Main factors which changes the maximum value of the air volume in the cylinder includes an EGR volume, that is, an exhaust recirculation volume. Referring to FIGS. 30, 31, the maximum value of the fuel injection volume or the gain is adjusted, depending upon a maximum value of the air volume in the cylinder which varies depending upon an EGR volume. The above-mentioned upper limit value TIOMax or the gain GTI0 is a value which is computed by fuel injection volume correcting parts 70*e*, 70*f* with reference to a table TblGTI0Max or a table TblGTI0 in view of a desired EGR rate TgEgr and the internal combustion engine speed Ne.

Set values on the table TblTi, the table TBITI0Max and the table TblGTI0 are desirably determined by data from real engines.

[Third Embodiment]

This embodiment relates to a control apparatus for adjusting the fuel supply volume in accordance with result of detection of exhaust gas components from an internal combustion engine.

The control apparatus for an internal combustion engine in this embodiment is the same as the control apparatus in the first embodiment, except the fuel injection volume computing part 62 and the fuel volume correction value computing part 70 (70*g*, 70*h*), and accordingly, detailed explanation thereof will be omitted.

2. The Fuel Injection Volume Computing Part and the Fuel Volume Correction Computing Part Referring to FIGS. 32 and 33 which show the fuel injection volume computing part 62 and the fuel volume correction value computing part 70 (70*g*, 70*h*), the desired combustion pressure torque TgTc is converted into a basic fuel injection volume Ti with the use of the table TblTi. This basic fuel injection volume ti is a fuel injection volume in one cylinder per cycle, and accordingly, the basic fuel injection volume Ti is in proportion to a torque. With this proportional relationship, the desired combustion pressure torque TgTc is converted into the basic fuel injection volume Ti.

Figure 32:
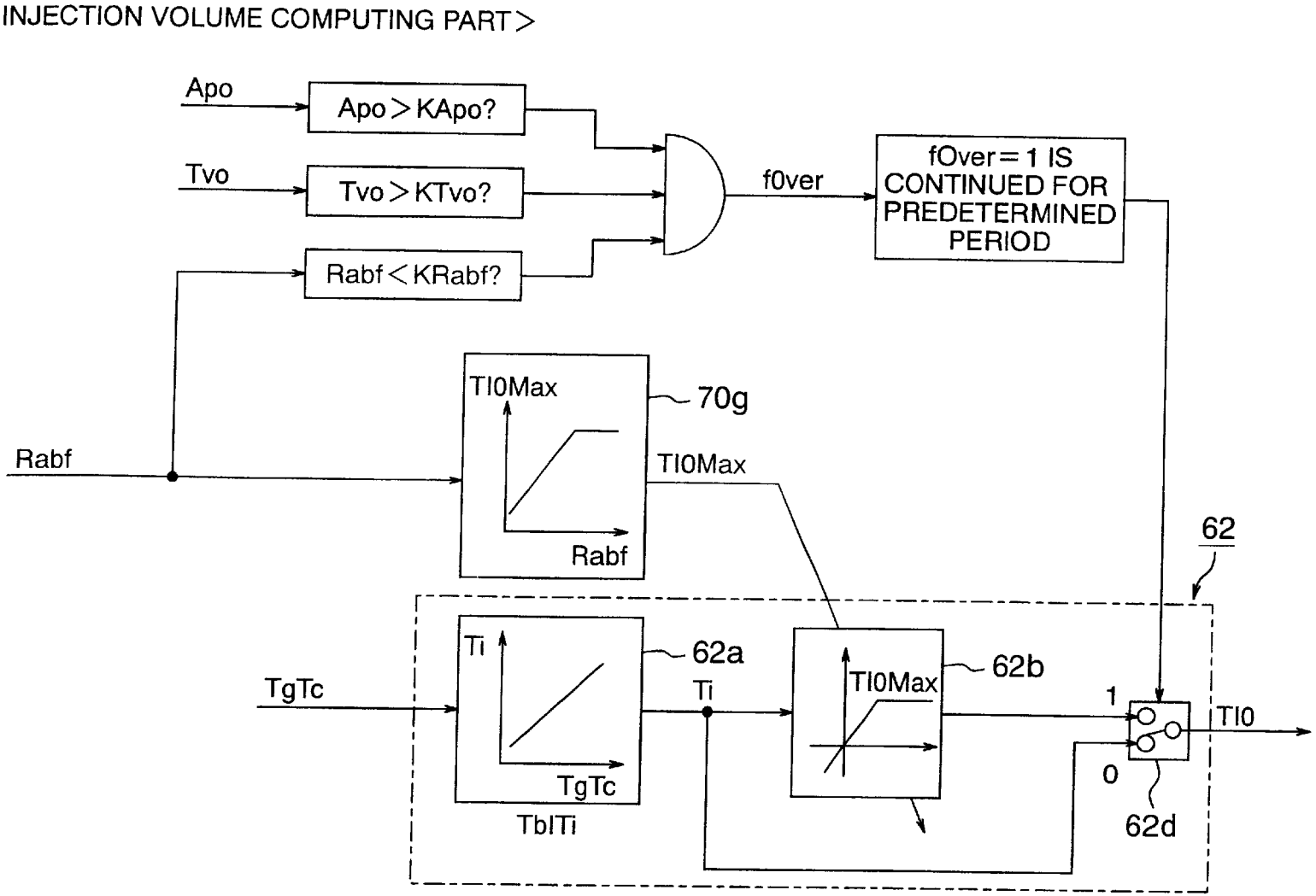
FIG. 32 is a control block diagram illustrating a fuel injection volume computing part and a fuel volume correction value computing part in a third embodiment of the control apparatus for an internal combustion engine according to the present invention.

Further, as shown in FIG. 32, the basic fuel injection volume Ti is limited to the upper limit value TIOMax of the basic fuel injection volume by the upper limiter 62*b*, and thereafter, the fuel injection volume TIO is computed. The upper limit value TIOMax is a value which is computed by referring to a table TblTIO max in the fuel volume correction value computing part 70*g* in view of an exhaust air-fuel ratio Rabf detected by the A/F sensor 12.

Further, only when the following conditions (1) to (3) are all satisfied:

$$Apo>Kapo \quad (1)$$

$$Tvo>Ktvo \quad (2)$$

$$Rabf<Rrabf \quad (3)$$

the change-over is made by the changing part 62*d* so as to effect the limit TIOMax. It is noted here that Apo is an accelerator opening degree, and Tvo is a throttle opening degree. That is, when such a condition that the accelerator opening degree is greater than a predetermined value (for example, in the vicinity of the full opening degree) while the throttle opening degree is greater than a predetermined value (for example in the vicinity of the full opening degree), and the air-fuel ratio is less than a predetermined value (for example, a theoretical air-fuel ratio) is satisfied, it is determined that the air volume corresponding to the full opening of the throttle is decreased due to any reason so as to cause an excessive fuel condition, and accordingly, the fuel volume is limited. A value for the limitation is adjusted, depending upon an exhaust air-fuel ratio Rabf exhibiting an excessive fuel degree.

Figure 33:
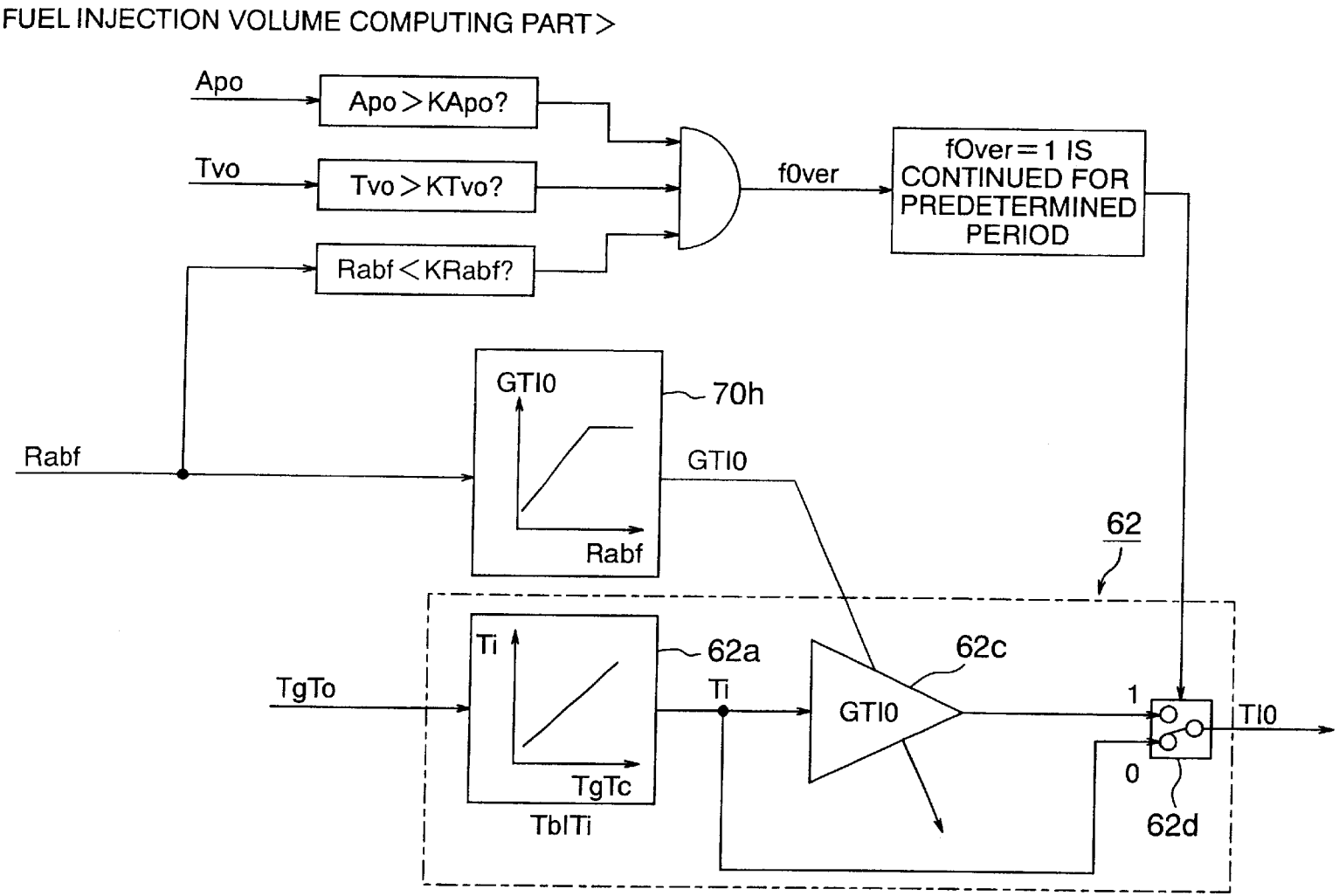
FIG. 33 is another block diagram illustrating a fuel injection volume computing part and a fuel volume correction value computing part in the third embodiment of the control apparatus for an internal combustion engine according to the present invention.

Further, as shown in FIG. 33, the basic fuel injection volume Ti may be multiplied with the gain GT0 so as to be converted into the fuel injection volume TI0. It is noted that the gain GTI0 is computed by the fuel volume correction computing part 70*h* by referring to the table TblGTI0 in view of the exhaust air-fuel ratio Rabf.

Set values on the tables Kapo, Ktvo, Krabf, TblTi, TblTIO0ax and TblGTI0 are preferably obtained by data from real engines.

[Fourth Embodiment]

This embodiment relates to a control apparatus for adjusting the fuel supply volume by detecting a maximum torque nonvolatilized condition in accordance with an accelerator opening degree, a throttle opening degree and an actual air volume.

The control apparatus for an internal combustion engine in this embodiment is the same as the control apparatus for an internal combustion engine, except the fuel injection volume computing part 62 and the fuel volume correction value computing part 70, and accordingly, detailed explanation thereof will be omitted.

2. The Fuel Injection Volume Computing Part and the Fuel Volume Correction Computing Part Referring to FIGS. 34 and 35 which show the fuel injection volume computing part 62 and the fuel volume correction value computing part 70 (70*g*, 70*h*), the desired combustion pressure torque TgTc is converted into a basic fuel injection volume Ti with the use of the table TblTi. This basic fuel injection volume ti is a fuel injection volume in one cylinder per cycle, and accordingly, the basic fuel injection volume Ti is in proportion to a torque. With this proportional relationship, the desired combustion pressure torque TgTc is converted into the basic fuel injection volume Ti.

Figure 34:
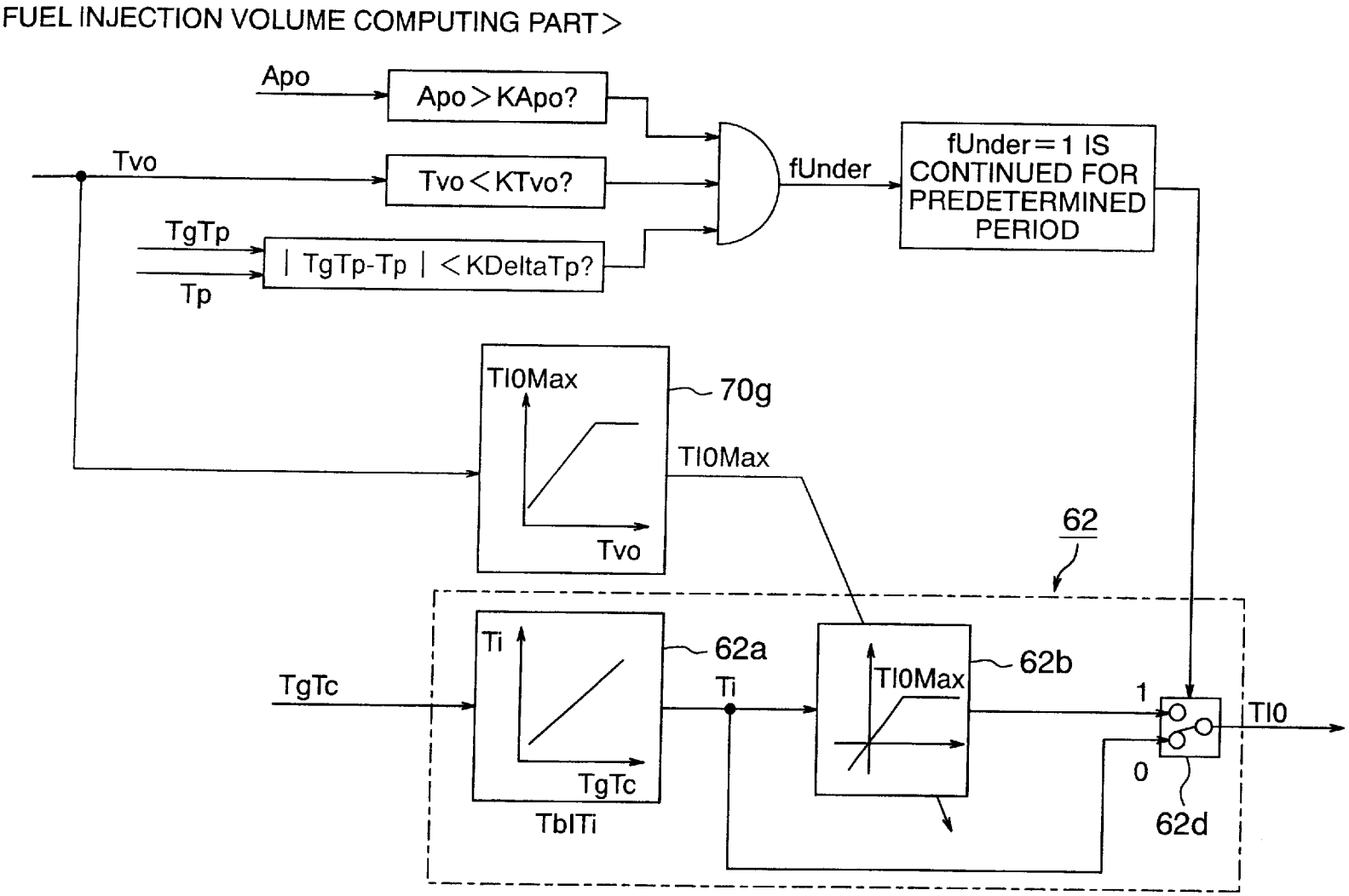
FIG. 34 is a control block diagram illustrating a fuel injection volume computing part and a fuel volume correction value computing part in a forth embodiment of the control apparatus for an internal combustion engine according to the present invention.

Further, as shown in FIG. 34, the basic fuel injection volume Ti is limited to the upper limit value TIOMax of the basic fuel injection volume by the upper limiter 62*b*, and thereafter, the fuel injection volume TIO is computed. The upper limit value TIOMax is a value which is computed by referring to a table TblTIO max in the fuel volume correction value computing part 70*g* in view of a throttle opening degree Tvo.

Further, only when the following conditions (4) to (6) are all satisfied:

$$Apo>Kapo \quad (4)$$

$$Tvo<Ktvo \quad (5)$$

$$|ITgTp-Tp|<KDeltaTp \quad (6)$$

the change-over is made by the changing part 62*d* so as to effect the limit TIOMax. It is noted here that Apo is an accelerator opening degree, Tvo is a throttle opening degree, TgTp is a desired air volme and Tp is an actual air volume. That is, when such a condition that the accelerator opening degree is greater than a predetermined value (for example, in the vicinity of the full opening degree) while the throttle opening degree is less than a predetermined value, and the actual air volume is around the desired air volume TgTp is satisfied, the air volume corresponding to the full opening of the throttle is increased due to any reason, and accordingly, the throttle is not fully opened even though the accelerator is fully opened so as to demand a maximum fuel volume. Thus, a process for increasing the maximum fuel volume is carried out so as to increase the maximum torque. The increasing value is adjusted in accordance with the throttle opening degree Tvo.

Figure 35:
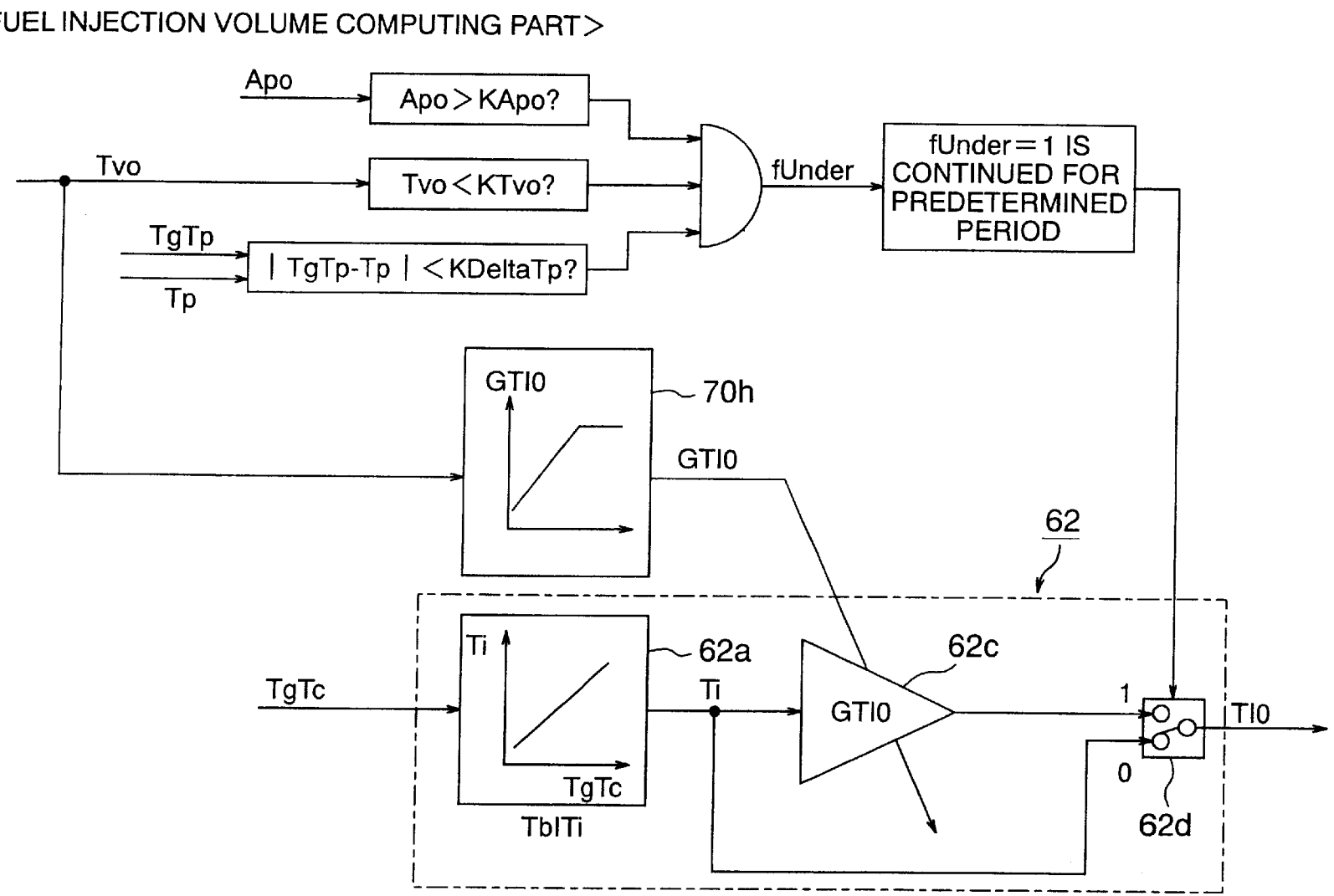
FIG. 35 is another control block diagram illustrating a fuel injection volume computing part and a fuel volume correction value computing part in the forth embodiment of the control apparatus for an internal combustion engine according to the present invention.

Further, as shown in FIG. 35, the basic fuel injection volume Ti may be multiplied with the gain GT0 so as to be converted into the fuel injection volume TI0. It is noted that the gain GTI0 is computed by the fuel volume correction computing part 70*h* with reference to the table TblGTI0 in view of the throttle opening degree Tvo.

Set values on the tables Kapo, Ktvo, KDeltaTp, TblTi, TblTIO0ax and TblGTI0 are preferably obtained by data from real engines.

[Fifth Embodiment]

This embodiment relates to a control apparatus for adjusting the fuel supply volume by detecting an excessive fuel supply condition, depending upon an accelerator opening degree, a throttle valve opening degree and an actual air volume.

The control apparatus for an internal combustion engine in this embodiment is the same as the control apparatus for an internal combustion engine, except the fuel injection volume computing part 62 and the fuel volume correction value computing part 70 (70*i*, 70*j*), and accordingly, detailed explanation thereof will be omitted.

2. The Fuel Injection Volume Computing Part and the Fuel Volume Correction Computing Part Referring to FIGS. 36 and 37 which show the fuel injection volume computing part 62 and the fuel volume correction value computing part 70, the desired combustion pressure torque TgTc is converted into a basic fuel injection volume Ti with the use of the table TblTi in a basic air volume computing part 62*a*. This basic fuel injection volume ti is a fuel injection volume in one cylinder per cycle, and accordingly, the basic fuel injection volume Ti is in proportion to a torque. With this proportional relationship, the desired combustion pressure torque TgTc is converted into the basic fuel injection volume Ti.

Figure 36:
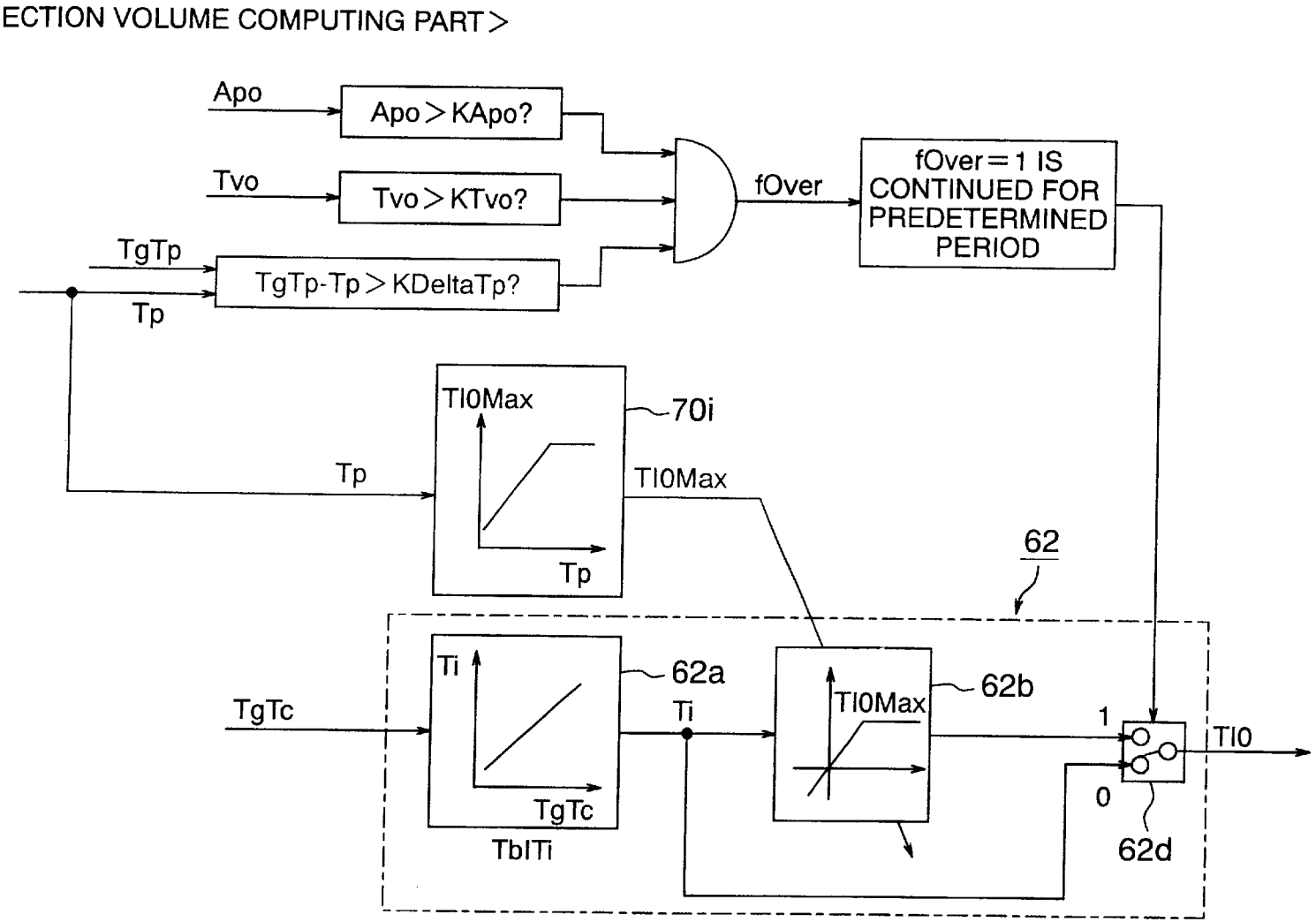
FIG. 36 is a control block diagram illustrating a fuel injection volume computing part and a fuel volume correction value computing part in a fifth embodiment of the control apparatus for an internal combustion engine according to the present invention.

Further, as shown in FIG. 36, the basic fuel injection volume Ti is limited to the upper limit value TIOMax of the basic fuel injection volume by the upper limiter 62*b*, and thereafter, the fuel injection volume TI0 is computed. The upper limit value TIOMax is a value which is computed by referring to a table TblTIO max in the fuel volume correction value computing part 70*i* in view of an actual air volume Tp.

Further, only when the following conditions (7) to (9) are all satisfied:

$$Apo>Kapo \quad (7)$$

$$Tvo<Ktvo \quad (8)$$

$$|TgTp-Tp|<KDeltaTp \quad (9)$$

the change-over is made by the changing part 62*d* so as to effect the limit TIOMax. It is noted here that Apo is an accelerator opening degree, Tvo is a throttle opening degree, TgTp is a desired air volume and Tp is an actual air volume. That is, when such a condition that the accelerator opening degree is greater than a predetermined value (for example, in the vicinity of the full opening degree) while the throttle opening degree is greater than a predetermined value (for example, in the vicinity of the full opening degree), and the difference between the desired air volume TgTp and the actual air volume Tp is greater than a predetermine value, is satisfied, the air volume corresponding to the full opening of the throttle is decreased due to any reason, and accordingly, it is determined that the actual air volume To for obtaining the desired air volume TgTp cannot be obtained so that an excessive fuel condition is caused. Thus, the fuel volume is limited. The value to be limited is adjusted in accordance with the actual air volume upon full opening of the throttle.

Figure 37:
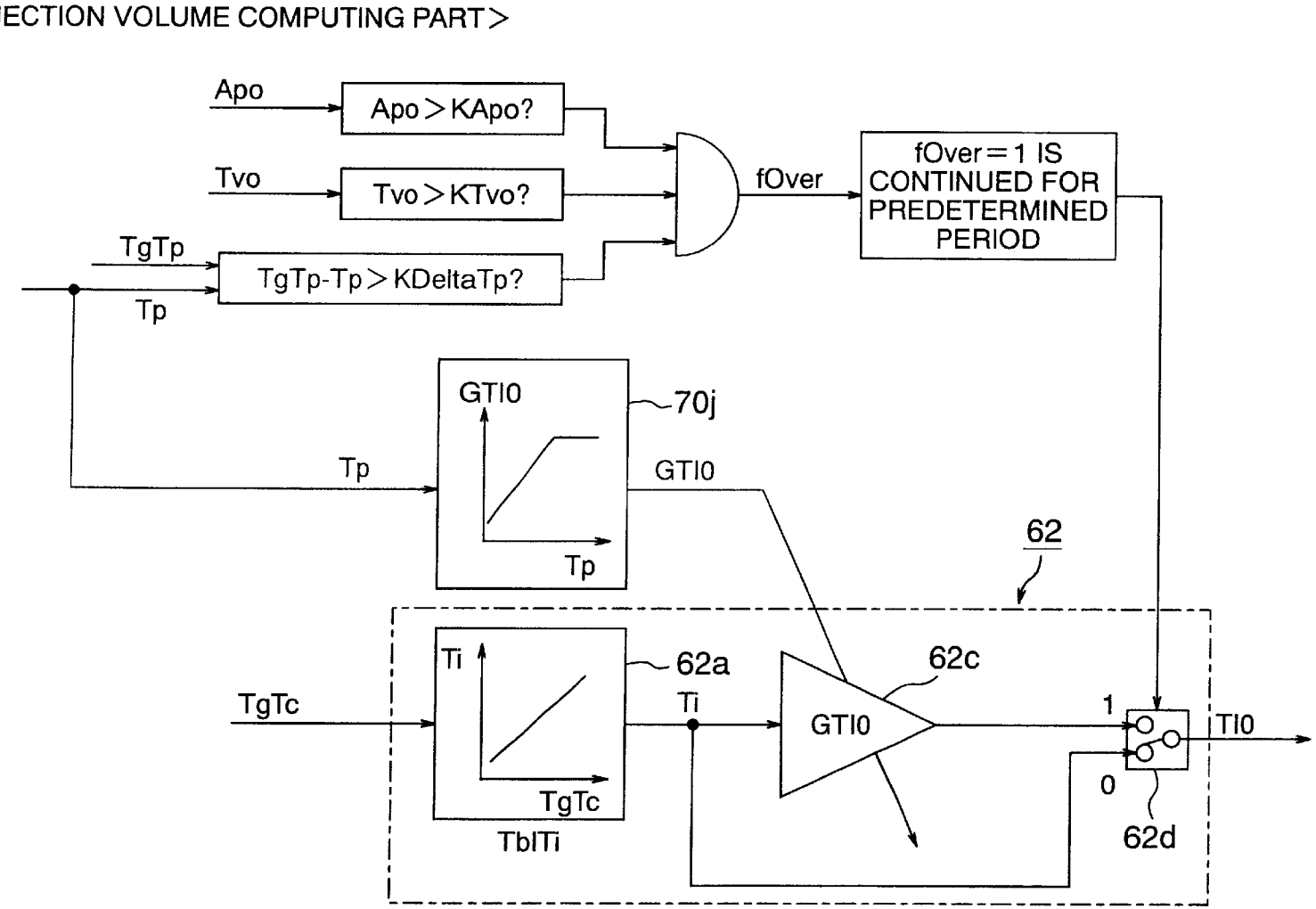
FIG. 37 is another control block diagram illustrating a fuel injection volume computing part and a fuel volume correction value computing part in the fifth embodiment of the control apparatus for an internal combustion engine according to the present invention.

Further, as shown in FIG. 37, the basic fuel injection volume Ti may be multiplied with the gain GT0 so as to be converted into the fuel injection volume TI0. It is noted that the gain GTI0 is computed by the fuel volume correction computing part 70*i* with reference to the table TblGTI0 in view of the actual air volume Tp. Set values on the tables Kapo, Ktvo, KDeltaTp, TblTi, TblTIO0ax and TblGTI0 are preferably obtained by data from real engines.

Although detailed explanation has been hereinabove made of the five embodiments, the present invention should be limited to the above-mentioned embodiments, but various modification in design can be made thereto without departing the concept of the present invention stated in the appended claims.

The control apparatus in any of the first to fifth embodiments, is to limit the maximum value of the total fuel supply volume with the use of the limiter and the gain. Accordingly, it incorporates a function for adjusting fuel supply volume TgTa required by the accelerator so as to prevent the supply volume from exceeding the maximum air volume even though the internal limiter Tg varies due to unevenness in mass production and aging effect. Further, the gain GTI0 for the control apparatus in any of the first to fifth embodiments can be applied to TgTa.

Further, although explanation has been made of the means for adjusting the fuel volume in accordance with an maximum air volume in any of the first to fifth embodiments, the maximum air volume can be increased in the case of the provision of a super charger. For example, if the desired air volume cannot be obtained even though the throttle is fully opened, there may be used such a method that can cope with this problem by increasing the maximum air volume through supercharger.

What is claimed is:

1. A control apparatus for a fuel priority type internal combustion engine, for computing a desired fuel volume and computing a desired air volume from the desired fuel volume and a desired air-fuel ratio, comprising:

detector configured to detect an operating condition of the internal combustion engine; a detector configured to detect an environmental condition surrounding the internal combustion engine;

an apparatus to compute a maximum injection quantity when an accelerator is fully opened in accordance with the detected operating condition of the internal combustion engine and the detected environmental condition surrounding the internal combustion engine.

2. A control apparatus for a fuel priority type internal combustion engine, comprising a detector configured to detect an operating condition of the internal combustion engine; a detetor configured to detect an environmental condition surrounding the internal combustion engine; an apparatus configured to compute a desired fuel volume to be fed into the internal combustion engine in accordance with the operating condition of the internal combustion engine and the environmental condition surrounding the internal combustion engine, and an apparatus configured to compute a computation value of a maximum injection quantity with a fully opened accelerator in accordance with the detected operating condition of the engine and the detected environmental condition surrounding the internal combustion engine.

3. A control apparatus as set forth in claim 1 or 2, wherein the desired fuel volume computing apparatus is configured to compute a desired fuel volume from at least an accelerator opening degree and a speed of the internal combustion engine.

4. A control apparatus as set forth in claim 1 or 2, the environmental condition detector is configured to detect an atmospheric pressure and an atmospheric temperature.

5. A control apparatus as set forth in claim 1 or 2, wherein the engine operating condition detector is configured to detect an opening degree of an EGR valve, opening and closing timings of variable intake and exhaust valves, and, directly or indirectly a charging efficiency of air volume in a cylinder, in the internal combustion engine.

6. A control apparatus as set forth in claim 1 or 2, wherein the engine operating condition is configured to detect directly or indirectly, a torque or a fuel volume required for allowing the internal combustion engine to maintain a desired speed in an idle condition.

7. A control apparatus as set forth in claim 1 or 2, wherein the engine operating condition of the internal combustion engine is configured to detect exhaust gas components from the internal combustion engine.

8. A control apparatus as set forth in claim 1 or 2, wherein the engine operating condition detector includes at least an accelerator opening degree sensor for detecting an accelerator opening degree, a throttle opening degree sensor for detecting a throttle opening degree, and an air volume detector for directly or indirectly detecting an air volume flowing into the internal combustion engine.

9. A control apparatus as set forth in claim 8, further comprising apparatus configured to compute a desired air-fuel ratio, and a desired air volume computing means for computing and a desired air volume from the desired fuel volume and the desired fuel-air ratio.

10. A control apparatus as set forth in claim 8, further comprising apparatus configured to compute a desired air-fuel ratio and a desired air volume from the desired fuel volume and the desired fuel-air ratio, and, the compensation value computing apparatus is configured to compute the compensation value when the desired air volume is greater than an actual air volume by a predetermined value, and accelerator opening degree is greater than a predetermined value associated therewith a throttle valve opening degree is greater than a predetermined value associated therewith.

11. A control apparatus as set forth in claim 2 wherein the desired fuel volume correction value computing apparatus is configured to compute a maximum value of the desired fuel volume or an increase in the relationship between one of an accelerator opening degree and a throttle opening degree and the desired fuel volume.

12. A control apparatus as set forth in claim 5, wherein the engine operator condition detector is configured to detect an operating angle of an intake flow enhancer.

13. A control apparatus for a internal combustion engine characterized by means for detecting an operating condition of the internal combustion engine, means for detecting a condition surrounding the internal combustion engine, and a charging efficiency control means for controlling a charging efficiency of an air volume in a cylinder, such as a super charger, and characterized in that the charging efficiency control means is controlled in accordance with an operating condition of the internal combustion engine, and an environmental condition surrounding the internal combustion engine.

14. A control apparatus for a fuel priority type internal combustion engine, for computing a desired fuel volume and computing a desired air volume from the desired fuel volume and a desired air-fuel ratio, comprising:

an operating condition of the internal combustion engine including an opening degree of an EGR valve, opening and closing timings of variable intake and exhaust valves, and, directly or indirectly a charging efficiency of air volume in a cylinder, in the internal combustion engine; an environmental condition surrounding the internal combustion engine; and apparatus configured to compute a desired fuel volume for the internal combustion engine in accordance with the operating detected condition of the internal combustion engine and the detected environmental condition surrouding the internal combustion engine.

15. A control apparatus as set forth in claim 14, wherein the engine operator condition detector is configured to detect an operating angle of an intake flow enhancer.

16. A control apparatus for a fuel priority type internal combustion engine, comprising apparatus configured to detect an operating condition of the internal combustion engine an opening degree of an EGR valve, opening and closing timings of variable intake and exhaust valves, and, directly or indirectly a charging efficiency of air volume in a cylinder, in the internal combustion engine; an environmental condition surrounding the internal combustion engine; and apparatus configured to compute a desired fuel volume to bed into the internal combustion engine in accordance with the operating condition of the internal combustion engine and the environmental condition surrounding the internal combustion engine, and a means for computing a correction value for the desired fuel volume from the operating condition of the engine, and a condition surrounding the internal combustion engine.

17. A control apparatus as set forth in claim 16, wherein the engine operator condition detector is configured to detect an operating angle of an intake flow enhancer.

18. A control apparatus for an internal combustion engine, comprising apparatus configured to detect an operating condition of the internal combustion engine and a condition surrounding the internal combustion engine; and apparatus configured to control a charging efficiency of a cylinder air volume, the charging efficiency control apparatus being controlled in accordance with the detected operating condition of the internal combustion engine and the environmental condition surrounding the internal combustion engine.

* * * * *